US007734233B2

(12) United States Patent
Aoki et al.

(10) Patent No.: US 7,734,233 B2
(45) Date of Patent: Jun. 8, 2010

(54) DEVELOPMENT DEVICE, PROCESS CARTRIDGE, AND IMAGE FORMING APPARATUS

(75) Inventors: Katsuhiro Aoki, Kanagawa (JP); Hideki Zemba, Kanagawa (JP); Tomoko Takahashi, Kanagawa (JP); Nobuaki Kondoh, Kanagawa (JP); Masanori Horike, Kanagawa (JP); Masaaki Yamada, Tokyo (JP); Takeo Tsukamoto, Kanagawa (JP); Hideki Kosugi, Kanagawa (JP); Ichiro Kadota, Kanagawa (JP); Yoshinori Nakagawa, Kanagawa (JP); Yasuyuki Ishii, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 108 days.

(21) Appl. No.: 11/734,389

(22) Filed: Apr. 12, 2007

(65) Prior Publication Data

US 2007/0242985 A1 Oct. 18, 2007

(30) Foreign Application Priority Data

Apr. 17, 2006 (JP) ..... 2006-112835
Jan. 30, 2007 (JP) ..... 2007-018767

(51) Int. Cl.
*G03G 15/08* (2006.01)

(52) U.S. Cl. ..... 399/266; 399/284

(58) Field of Classification Search ..... 399/266, 399/290, 291, 285, 270, 271, 55, 274, 184
See application file for complete search history.

(56) References Cited

U.S. PATENT DOCUMENTS 4,444,864 A * 4/1984 Takahashi ..... 430/122.8
4,901,116 A * 2/1990 Haneda et al. ..... 399/274
5,027,157 A * 6/1991 Hotomi et al. ..... 399/253
5,899,608 A * 5/1999 Eklund et al. ..... 399/266

(Continued)

FOREIGN PATENT DOCUMENTS

JP 62177576 A * 8/1987

(Continued)

OTHER PUBLICATIONS

U.S. Appl. No. 11/868,698, filed Oct. 8, 2007, Tsukamoto, et al.

(Continued)

*Primary Examiner*—David M Gray
*Assistant Examiner*—Gregory H Curran
(74) *Attorney, Agent, or Firm*—Oblon, Spivak, McClelland, Maier & Neustadt, L.L.P.

(57) ABSTRACT

A disclosed development device includes: a latent image carrier; a conveying member disposed so as to face the latent image carrier, the conveying member having plural electrodes insulated from one another and arranged at predetermined intervals so as to generate an electric field for moving toner on the conveying member; a voltage application unit applying a voltage of n phases (n is a positive integer not less than one) to the electrodes so as to form a cloud of the toner and the toner is adhered to the latent image carrier so as to form a visualized toner image; a toner supply unit supplying the toner to the conveying member; and a height adjusting member adjusting a uniform height for a toner layer of the toner immediately before a development area on the conveying member in which development is performed.

16 Claims, 32 Drawing Sheets

U.S. PATENT DOCUMENTS

| | | | | |
|---|---|---|---|---|
| 6,292,643 | B1 * | 9/2001 | Vo | 399/252 |
| 6,415,127 | B1 * | 7/2002 | Yamamoto et al. | 399/284 |
| 6,597,884 | B2 * | 7/2003 | Miyaguchi et al. | 399/266 |
| 6,901,231 | B1 * | 5/2005 | Sakai et al. | 399/266 |
| 6,901,232 | B2 * | 5/2005 | Sakuma et al. | 399/266 |
| 6,934,496 | B2 * | 8/2005 | Sakuma et al. | 399/265 |
| 7,123,864 | B2 | 10/2006 | Miyaguchi et al. | |
| 2004/0126692 | A1 * | 7/2004 | Yamanouchi et al. | 430/110.3 |
| 2004/0240907 | A1 * | 12/2004 | Miyaguchi et al. | 399/254 |
| 2006/0210320 | A1 | 9/2006 | Nakagawa et al. | |
| 2006/0251449 | A1 | 11/2006 | Takahashi et al. | |
| 2007/0019995 | A1 * | 1/2007 | Teraoka et al. | 399/281 |
| 2007/0025775 | A1 | 2/2007 | Takahashi et al. | |
| 2007/0086811 | A1 * | 4/2007 | Tsukamoto et al. | 399/265 |

FOREIGN PATENT DOCUMENTS

| | | |
|---|---|---|
| JP | 2004-198675 | 7/2004 |

OTHER PUBLICATIONS

U.S. Appl. No. 11/868,735, filed Oct. 8, 2007, Tsukamoto, et al.
U.S. Appl. No. 12/042,892, filed Mar. 5, 2008, Tsukamoto, et al.
U.S. Appl. No. 12/049,838, filed Mar. 17, 2008, Senoh, et al.
U.S. Appl. No. 12/121,122, filed May 15, 2008, Kadota et al.
U.S. Appl. No. 12/140,032, filed Jun. 16, 2008, Ishii, et al.
U.S. Appl. No. 12/170,930, filed Jul. 10, 2008, Takahashi, et al.
U.S. Appl. No. 12/176,054, filed Jul. 18, 2008, Kadota, et al.
U.S. Appl. No. 12/261,302, filed Oct. 30, 2008, Kosugi, et al.
U.S. Appl. No. 12/209,812, filed Sep. 12, 2008, Aoki, et al.

* cited by examiner

DEVELOPMENT DEVICE, PROCESS CARTRIDGE, AND IMAGE FORMING APPARATUS

BACKGROUND OF THE INVENTION

1. Field of the Invention

The present invention generally relates to a development device, a process cartridge, and an image forming apparatus and more particularly to a development device using what is called the ETH (Electrostatic Transport & Hopping) phenomenon in which two-component magnetic brush development is used so as to charge toner and form an electric field, the toner is transferred to a conveying electric field formed on a conveying base in accordance with force of the electric field, and the toner is transferred to a development area, a development device using what is called a flare phenomenon in which the toner is conveyed in accordance with movement of a surface of a conveying member in addition to the electric field, a process cartridge provided with the development device, and an image forming apparatus.

2. Description of the Related Art

Conventionally, there have been known development devices for performing development supplying developer to a latent image carrier without directly bringing the developer on a developer carrier into contact with the latent image carrier. Patent Document 1, for example, discloses a development device for supplying toner to the latent image carrier by using a conveying member. This conveying member is disposed so as to face the latent image carrier and plural electrodes are arranged on a surface thereof at a predetermined pitch. An alternating voltage of n phases is applied to the electrodes so as to generate a progressive-wave electric field for conveying toner. In accordance with the progressive-wave electric field, the toner is conveyed to a development area facing the latent image carrier while the toner is hopping in the vertical direction. While the toner conveyed to the development area is further hopping in the vertical direction, the toner receive force so as to be directed to the latent image carrier in an image area and to the conveying member in a non-image area, so that the image area is developed.

Patent Document 1: Japanese Laid-Open Patent Application No. 2004-198675

However, in these conventional development devices, unevenness of a toner cloud layer is generated in a supply area, a conveying area, and the development area. Toner moves from the supply area to the development area in accordance with the electric field, so that it is impossible to form a high electric field and supply the toner or to bring a member carrying the toner into contact with the conveying member via the toner. When the member carrying the toner is brought into contact with the conveying member, the toner may be attached to the conveying base in accordance with electrostatic force of the toner, especially, image force and non-electrostatic force (Van der Waals force, in particular). This is referred to as "adhesion". When the toner is supplied in a non-contact manner so as to reduce the adhesion, a status of toner supply becomes uneven because of a supply gap and an uneven status of a magnetic brush. Further, the conveying member is formed using glass or resin with relatively high resistance and has at least a base layer, an electrode layer, and a surface layer. Thus, unevenness upon manufacturing such as resistance distribution, surface roughness distribution, and surface wettability may have an influence on an electric field to be formed. Moreover, in the development area, charge amount distribution becomes broad in addition to the supply and conveying, so that electric potential of the toner cloud layer becomes uneven depending on position. This has an influence on developing bias and an effective developing bias is fluctuated and becomes unstable.

SUMMARY OF THE INVENTION

It is a general object of the present invention to provide an improved and useful development device, process cartridge, and image forming apparatus in which the above-mentioned problems are eliminated.

A more specific object of the present invention is to provide a development device, process cartridge, and image forming apparatus that can form a uniform toner cloud layer and a uniform image and downsize an entire apparatus.

According to one aspect of the present invention, there is provided a development device including: a latent image carrier; a conveying member disposed so as to face the latent image carrier, the conveying member having plural electrodes insulated from one another and arranged at predetermined intervals so as to generate an electric field for moving toner on the conveying member; a voltage application unit applying a voltage of n phases (n is a positive integer not less than one) to the electrodes so as to form a cloud of the toner and the toner is adhered to the latent image carrier so as to form a visualized toner image; a toner supply unit supplying the toner to the conveying member; and a height adjusting member adjusting a uniform height for a toner layer of the toner immediately before a development area on the conveying member in which development is performed. Thus, it is possible to form a uniform toner cloud layer and a uniform image.

According to another aspect of the present invention, in the development device, the voltage application unit forms a progressive-wave electric field for moving the toner on the conveying member and the toner is conveyed to an area facing the latent image carrier. Thus, low voltage driving is possible, so that it is possible to perform high-quality development with high development efficiency.

According to another aspect of the present invention, in the development device, the toner is conveyed to the area facing the latent image carrier in accordance with movement of a surface of the conveying member in addition to the progressive-wave electric field formed by the voltage application unit.

According to another aspect of the present invention, in the development device, a potential difference is generated between an odd number electrode group as a collection of odd number electrodes and an even number electrode group as a collection of even number electrodes determined based on a predetermined electrode of the plural electrodes, and pulse voltages whose phases are shifted to each other are applied to the odd number electrodes and the even number electrodes, thereby moving the toner between the electrodes on the surface of the conveying member. Thus, when electric potential of one electrode is shifted to a plus side relative to a center of amplitude (Vpp) of the pulse voltage, it is possible to have electric potential of the other electrode shifted to a minus side relative to the center of amplitude. In accordance with this, it is possible to generate a potential difference between both electrodes, the potential difference being greater than a half of the amplitude of the pulse voltage. In such a structure, a desired potential difference is generated between both electrodes using a pulse voltage with smaller amplitude (Vpp) in comparison with a case where a pulse voltage is applied to one of the electrodes. Thus, it is possible to reduce generation of scumming.

According to another aspect of the present invention, the development device includes a voltage application unit applying a voltage to the height adjusting member. Thus, it is possible to have sharp charge amount distribution and form a toner cloud layer in a more uniform manner.

According to another aspect of the present invention, in the development device, the voltage application unit applies an alternating voltage to the height adjusting member.

According to another aspect of the present invention, in the development device, the height adjusting member is made of a material having flexibility. Thus, it is possible to absorb impact of collision of hopping toner and reduce speed, so that it is possible to have uniform height distribution of the toner cloud layer.

According to another aspect of the present invention, in the development device, the height adjusting member is oscillated. Thus, the oscillation affects the hopping toner and repulsion is absorbed, so that it is possible to adjust a uniform height for the toner cloud layer.

According to another aspect of the present invention, in the development device, plural perpendicular direction conveying electrodes are disposed on the conveying member at predetermined intervals, the plural perpendicular direction conveying electrodes forming an electric field in a perpendicular direction relative to an area formed with a conveying direction and a hopping direction of the toner, and the toner is oscillated in a perpendicular direction relative to the toner conveying direction through the electric field formed by the perpendicular direction conveying electrodes so as to adjust a uniform width for the toner and the uniform height is adjusted for the toner layer of the toner.

According to another aspect of the present invention, in the development device, coverage of additive for the toner is not less than 40%.

According to another aspect of the present invention, there is provided a process cartridge comprising: the above-mentioned development device; and at least one of a latent image carrier, a charging unit, and a cleaning unit in an electrophotographic process, wherein the process cartridge is detachable from a body of an image forming apparatus. Thus, it is possible to provide a process cartridge capable of forming a uniform toner cloud layer and a uniform image.

According to another aspect of the present invention, there is provided an image forming apparatus comprising: the above-mentioned development device or the above-mentioned process cartridge. Thus, it is possible to provide an image forming apparatus capable of forming a uniform toner cloud layer and a uniform image.

According to another aspect of the present invention, there is provided an image forming apparatus for forming a color image comprising plural process cartridges mentioned above. Thus, it is possible to provide an image forming apparatus for forming a color image capable of forming a uniform toner cloud layer and a uniform image.

In the development device according to the present invention, by disposing the height adjusting member adjusting a uniform height for the toner layer of the toner immediately before the development area for performing development on the conveying member, it is possible to form a uniform toner cloud layer and a uniform image.

Other objects, features and advantage of the present invention will become more apparent from the following detailed description when read in conjunction with the accompanying drawings.

DETAILED DESCRIPTION OF THE PREFERRED EMBODIMENTS

Figure 1:
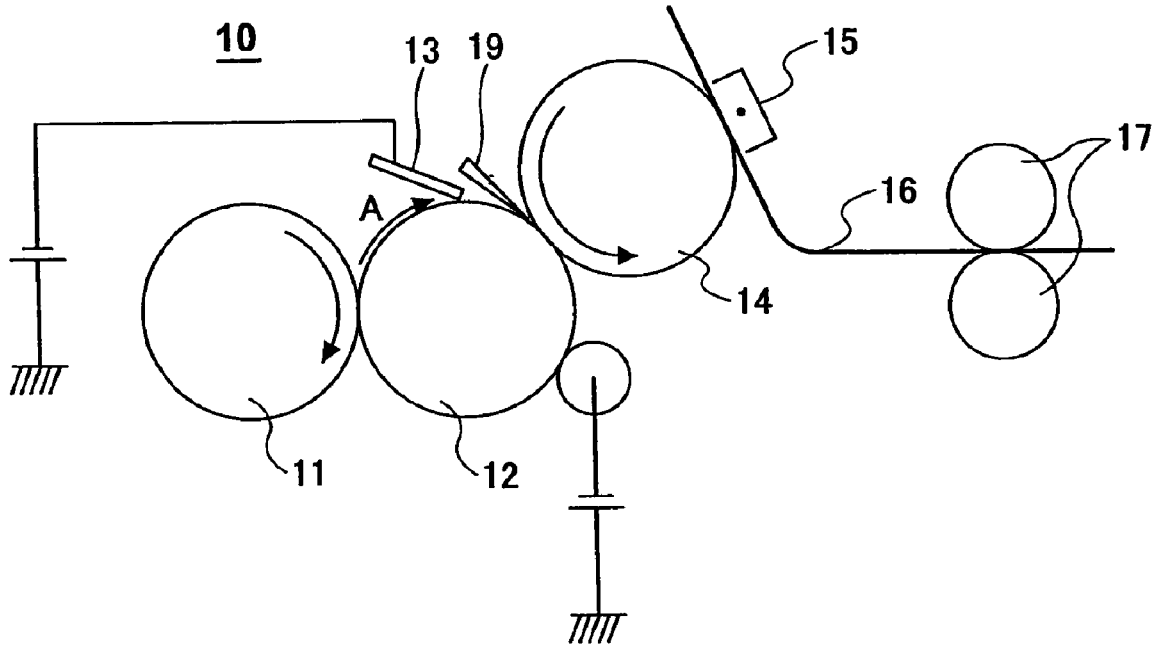
FIG. 1 is a schematic cross-sectional view showing a development device according to a first embodiment of the present invention.

FIG. 1 is a schematic cross-sectional view showing a development device according to a first embodiment of the present invention. In FIG. 1, a toner supply unit 11 carries changed toner and the toner is brought close to a closest portion of a conveying member 12. An electric field is formed between the toner supply unit 11 and the conveying member 12 and the toner is trapped in a conveying electric field formed on the conveying member 12 from electrostatic force received by the toner. The conveying member 12 has a three-phase electrode and is capable of conveying the charged toner by applying a conveying voltage of square waves while successively changing the conveying voltage. When the toner is conveyed, the toner forms what is called a cloud layer and moves in a direction indicated by arrow A in FIG. 1. Then, according to a development device 10 of the present embodiment, a uniform hopping height adjusting member 13 is disposed such that a predetermined gap is set between a surface of the conveying member 12 and the uniform hopping height adjusting member 13. In accordance with the uniform hopping height adjusting member 13, a hopping height is uniformly adjusted on the conveying member 12, and then the toner whose hopping height is uniformly arranged passes on a photoconductor 14 on which a latent image is formed, thereby developing the latent image on the photoconductor 14 using the toner and visualizing the image. Further, a regulation member 19 having a relatively long length in a longitudinal direction is disposed along a conveying direction of the conveying member 12 so as not to increase a cloud height due to disturbance of a toner layer when the toner whose hopping height is uniformly adjusted on the conveying member 12 is conveyed to a nip portion between the conveying member 12 and the photoconductor 14. A transfer charger 15 is disposed on a position facing the photoconductor 14 and a voltage is applied by the transfer charger 15 at a time when a transfer paper 16 passes on. Following a transfer step, the toner is fixed by a fixing unit 17 and an image is formed. In the present embodiment, coating conditions of additive are considered in addition to uniformly conveying the toner in terms of time by generating an air flow between the toner supply unit 11 and the conveying member 12 upon supplying the toner.

Figure 2:
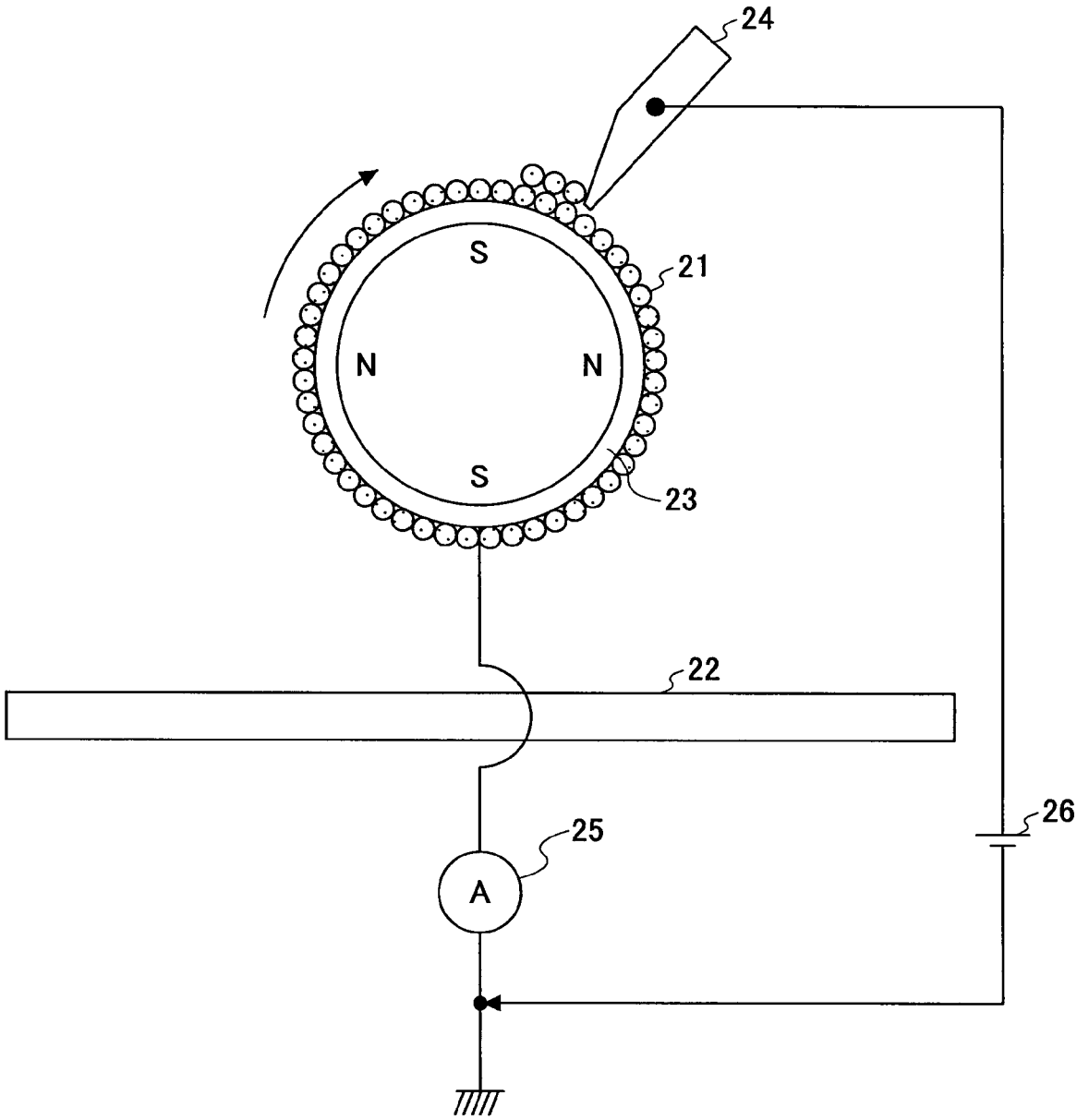
FIG. 2 is a schematic diagram showing a device for measuring magnetic particles.

FIG. 2 is a schematic diagram showing a device for measuring magnetic particles. In FIG. 2, magnetic particles 21 contain magnetic materials such as ferrite on metal or resin used as a core thereof. A surface layer of the conveying member is coated with silicon resin or the like. Preferably, a particle diameter of the magnetic particles 21 is within a range from 20 to 50 μm. Preferably, resistance of the magnetic particles 21 is within a range from $10^4$ to $10^{15}\Omega$ in terms of dynamic resistance DR. When the dynamic resistance DR of the magnetic particles 21 shown in FIG. 2 is measured, first, a rotatable sleeve 23 with a diameter of 20 mm including a stationary magnet at a predetermined position is disposed above a grounded base 22. An opposed electrode (doctor) 24 having an opposed area defined using a width W=65 mm and a length L=0.5 to 1.0 mm is disposed so as to face a surface of the sleeve 23 with a gap g=0.9 mm. Next, the sleeve 23 is rotated at a rotational speed of 600 rpm (linear velocity of 628 mm/sec). Then, a predetermined amount (14 g, for example) of the magnetic particles 21 to be measured is provided to the surface of the rotating sleeve 23 and the magnetic particles 21 is stirred for 10 minutes in accordance with the rotation of the sleeve 23. Next, a current IRII[A] flown between the sleeve 23 and the opposed electrode 24 is measured using an ammeter 25. Next, an upper limit of withstanding voltage (from 400 V in a high-resistance silicon sheet carrier to an applied voltage E[V], namely, 200 V in an iron powder carrier, for example) is applied to the sleeve 23 from a direct-current power supply 26 for five minutes. While the applied voltage E is applied, a current IRQ[A] is measured using the ammeter 25. From a measurement result, dynamic resistance DR[Ω] is calculated by using the following formula:

$$DR=E/(IRQ-IRII)$$

Figure 3:
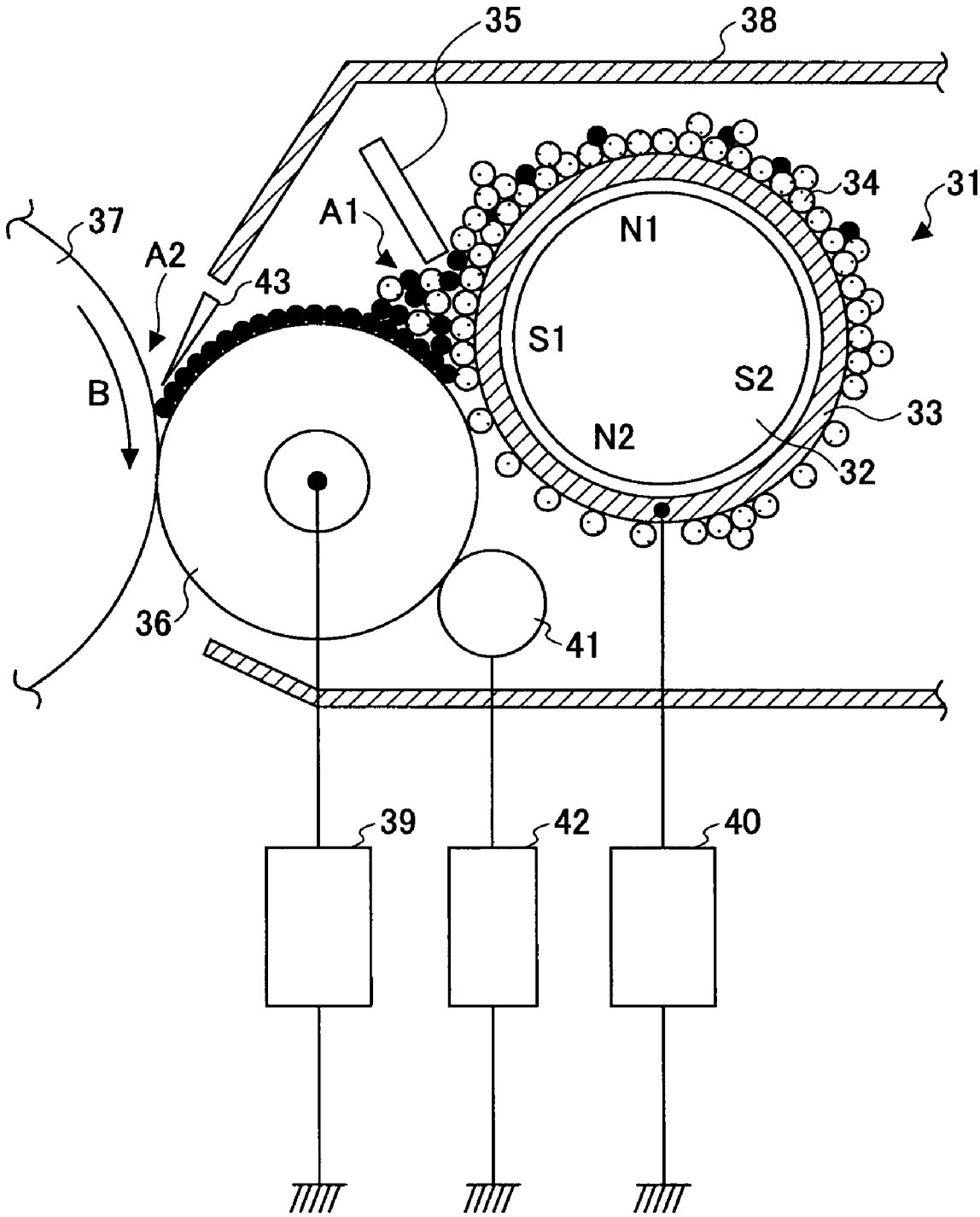
FIG. 3 is a schematic diagram showing another structure of a development device of the present invention.

FIG. 3 is a schematic diagram showing another structure of the development device of the present invention. In FIG. 3, a magnetic brush roller 31 is constituted using a non-magnetic rotatable sleeve 33 including a magnet member 32 having plural magnetic poles. The magnet member 32 is fixedly disposed and configured to apply magnetic force when developer 34 passes on a predetermined position on the sleeve 33. The sleeve 33 has a diameter of 18 mm and is subjected to a sandblast process so as to have surface roughness Rz (ten-point height of irregularities) within a range from 10 to 20 μm.

As shown in FIG. 3, the magnet member 32 included in the magnetic brush roller 31 has four magnetic poles of N-pole (N1), S-pole (S1), N-pole (N2), and S-pole (S2) from a regulation position of a regulation blade 35 in a rotation direction of the magnetic brush roller 31. Positions of the magnetic poles of the magnet member 32 are not limited to the positions shown in FIG. 3 and may be set to other positions depending on a position of the regulation blade 35, for example, around the magnetic brush roller 31. Further, five magnetic poles of N-pole (N1), S-pole (S1), N-pole (N2), S-pole (S2), and S-pole (S3) may be disposed from the regulation position of the regulation blade 35 in the rotation direction of the magnetic brush roller 31.

Then, the developer 34 made of toner and magnetic particles is carried on the sleeve 33 in a brush-like manner from magnetic force of the magnetic brush roller 31. The toner in the magnetic brush on the magnetic brush roller 31 obtains a specified amount of electrostatic charge by being mixed with the magnetic particles. Preferably, the amount of electrostatic charge of the toner on the magnetic brush roller 31 is within a range from −10 to −40 [μC/g].

A conveying member 36 is disposed so as to be brought into contact with the magnetic brush on the magnetic brush roller 31 in a toner supply area A1 adjacent to the magnetic pole N2 in the magnetic brush roller 31 and to face a photoconductor 37 in a development area A2. Moreover, a regulation member 43 having a relatively long length in a longitudinal direction is disposed along a conveying direction of the conveying member 36 so as not to increase a cloud height due to disturbance of a toner layer when the toner on the conveying member 36 is conveyed to the development area A2 between the conveying member 36 and the photoconductor 37. Further, a space in a closest portion between the regulation blade 35 and the magnetic brush roller 31 is set to be 500 μm and the magnetic pole N1 of the magnet member 32 facing the regulation blade 35 is positioned in an upstream of the rotation direction of the magnetic brush roller 31 relative to a position facing the regulation blade 35 as much as several degrees. In accordance with this, it is possible to readily form a circulating flow of the developer 34 in a casing 38.

The regulation blade 35 is brought into contact with the magnetic brush such that an amount of the developer 34 formed on the magnetic brush roller 31 is regulated at a portion facing the magnetic brush roller 31. Thus, a predetermined amount of the developer is conveyed to the toner supply area and frictional electrification of the toner and the magnetic particles in the developer 34 is accelerated.

The magnetic brush roller 31 is rotated by a rotation driving device not shown in the drawings in a direction indicated by arrow B in FIG. 3 and only the toner is supplied at the toner supply area A1. The gap between the conveying member 36 and the sleeve 33 of the magnetic brush roller 31 is set to be 1.1 mm at the toner supply area A1. Plural types of voltages are applied to conveying electrodes and a power source 39 is connected to the conveying electrodes. A power source 40 for applying a toner supply bias V VXS is connected to the sleeve 33 of the magnetic brush roller 31 so as to form an electric field for toner supply at the toner supply area A1.

The following describes supply, conveying, and development operations of the development device in FIG. 3. The developer 34 included in the casing 38 is made of a mixture of toner and magnetic particles and stirred through rotation force of a stirring/conveying member not shown in the drawings or the sleeve 33 of the magnetic brush roller 31 and through magnetic force of the magnet member 32. In this case, electric charges are applied to the toner from frictional electrification with the magnetic particles. On the other hand, the developer 34 carried on the magnetic brush roller 31 is regulated by the regulation blade 35 and a certain amount of the developer 34 is transferred to the conveying member through the electric field and the like formed from the toner supply bias and the remaining developer is returned to the casing 38.

At the toner supply area A1, the toner in the magnetic brush is separated and transferred to the conveying member. An AC bias voltage is applied to the magnetic brush roller 31. In the present embodiment, supply capacity of a supply unit is 0.6 [mg/cm$^2$] at a potential difference of 1000 [V]. In this case, rotation linear velocity of the sleeve 33 is 40 [cm/s] and conveying capacity of per width of 1 cm is expressed as: 0.6 [mg/cm$^2$]×40 [cm/s]=24 [mg/cm·s].

Figure 4:
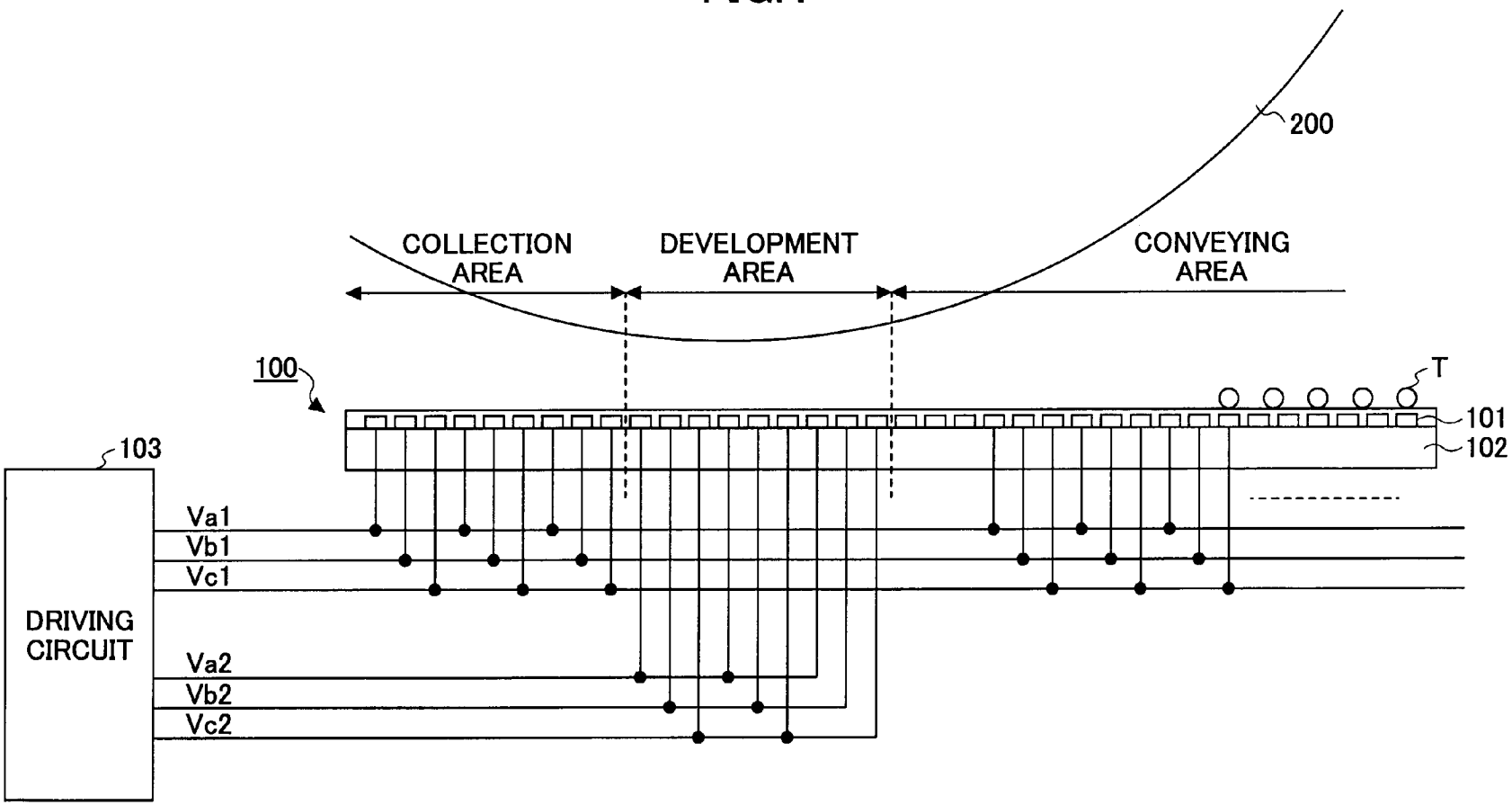
FIG. 4 is a schematic diagram showing a structure of a development device conveying electrostatic toner.

FIG. 4 is a schematic diagram showing a structure of a development device conveying electrostatic toner. A development device 100 shown in FIG. 4 includes a conveying base 102 as a conveying member in which plural conveying electrodes 101 for generating an electric field are arranged, the electric field causing the toner T as powder to be conveyed, hopping, and collected. Conveying voltages of n-phase (n is a positive integer not less than one, three-phase in this case) different driving waveforms Va1, Vb1, Vc1, Va2, Vb2, and Vc2 are applied to each of the conveying electrodes 101 on the conveying base 102 from a driving circuit 103 so as to generate a required electric field. In this case, the conveying base 102 is divided into a conveying area for conveying the toner T to the vicinity of a photoconductor drum 200, a development area for forming a toner image by attaching the toner T to a latent image on the photoconductor drum 200, and a collection area for collecting the toner T in the conveying base 102 after the toner T has passed on the development area, based on a relationship between a range of the conveying electrodes 101 applying the driving waveforms Va1, Vb1, Vc1, Va2, Vb2, and Vc2 and the photoconductor drum 200 as a latent image carrier.

In the development device 100, the toner T is conveyed to the vicinity of the photoconductor drum 200 in the conveying area of the conveying base 102. In the development area, an electric field is generated so as to direct the toner T to the photoconductor drum 200 relative to an image area of a latent image on the photoconductor drum 200 and to direct the toner T to an opposite side (conveying base 102) of the photoconductor drum 200 relative a non-image area, thereby attaching the toner T to the latent image and performing development. In the collection area, an electric field is formed so as to direct the toner T to the opposite side (conveying base 102) of the photoconductor drum 200 relative to both image area and non-image area of the latent image.

In accordance with this, in the development area, the toner is attached to the latent image on the photoconductor drum 200 and the image is visualized. Toner which does not contribute to the development is collected in the collection area of the conveying base 102 in a downstream of the rotation direction (movement direction) of the photoconductor drum 200. Thus, generation of scattered toner is prevented. It is possible to securely collect floating toner by disposing the collection area in the downstream of the movement direction of the latent image carrier relative to the development area.

Figure 5:
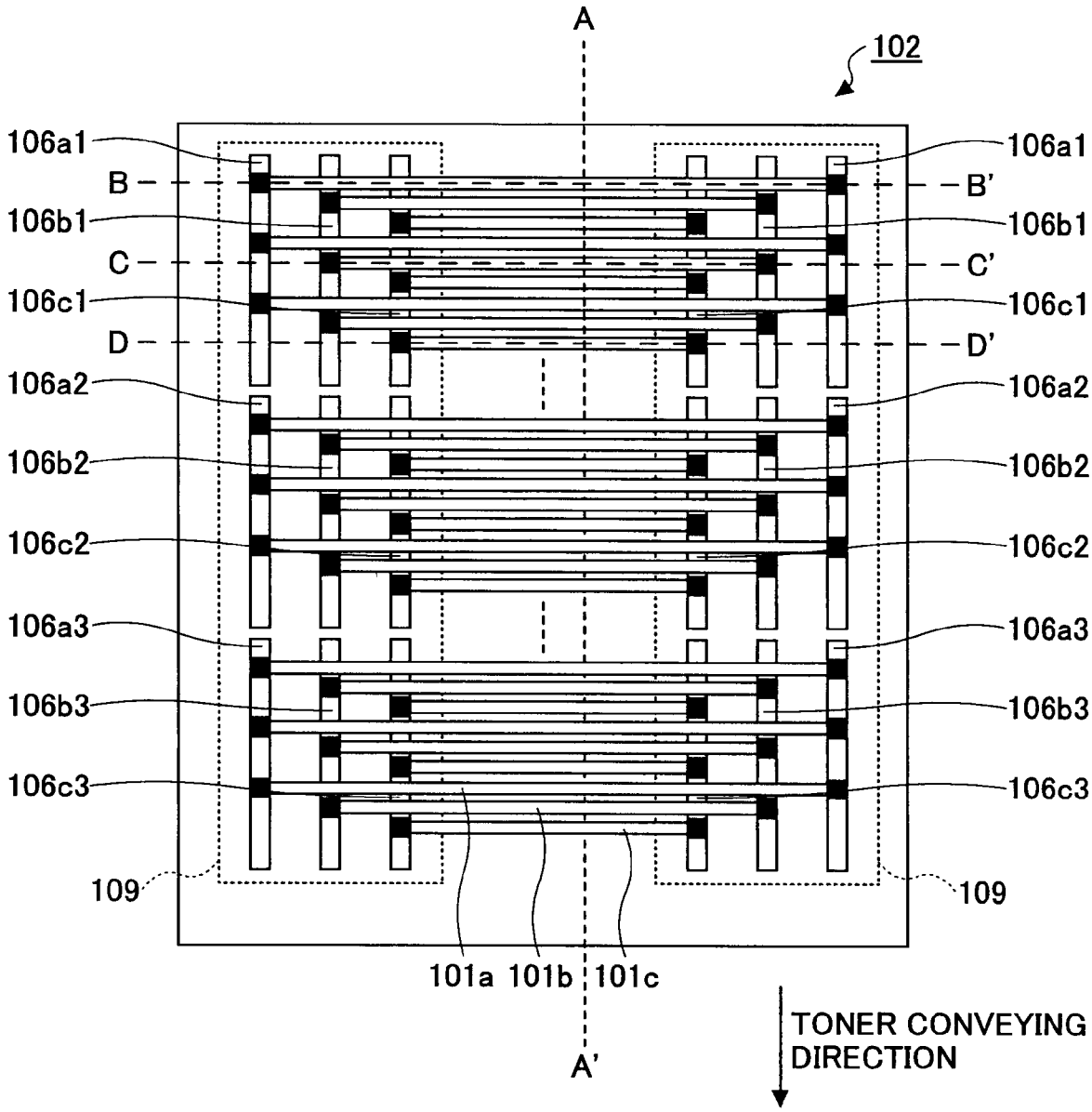
FIG. 5 is a plan view showing a conveying base of a development device.
Figure 6:
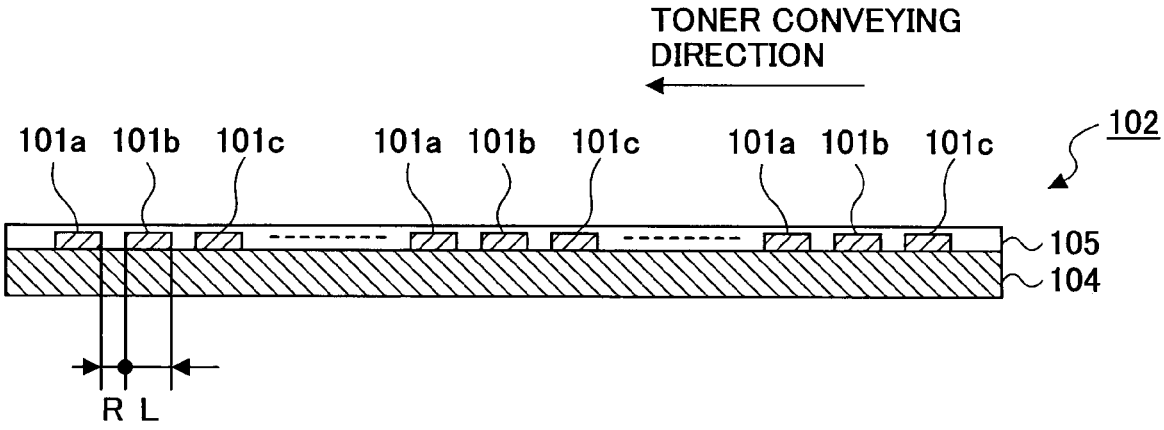
FIG. 6 is a cross-sectional view taken along line A-A' in FIG. 5.
Figure 7:
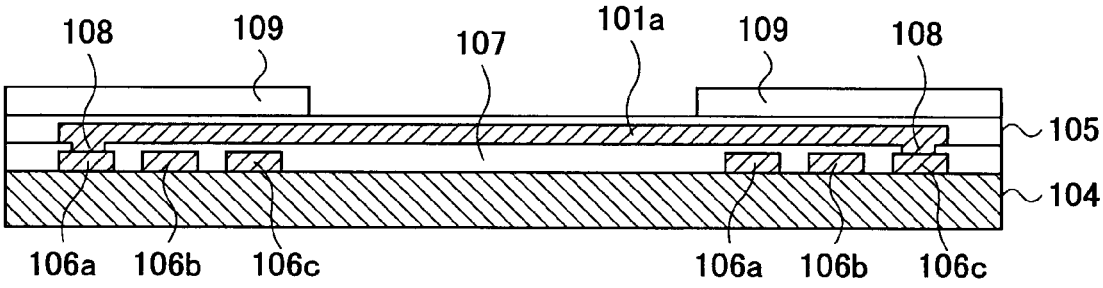
FIG. 7 is a cross-sectional view taken along line B-B' in FIG. 5.
Figure 8:
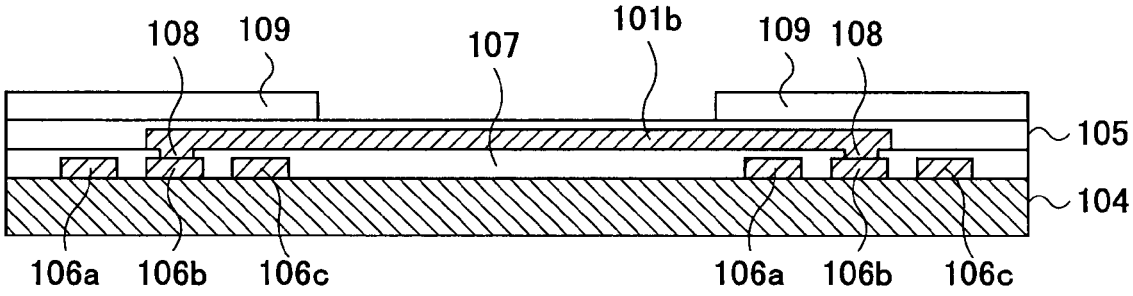
FIG. 8 is a cross-sectional view taken along line C-C' in FIG. 5.
Figure 9:
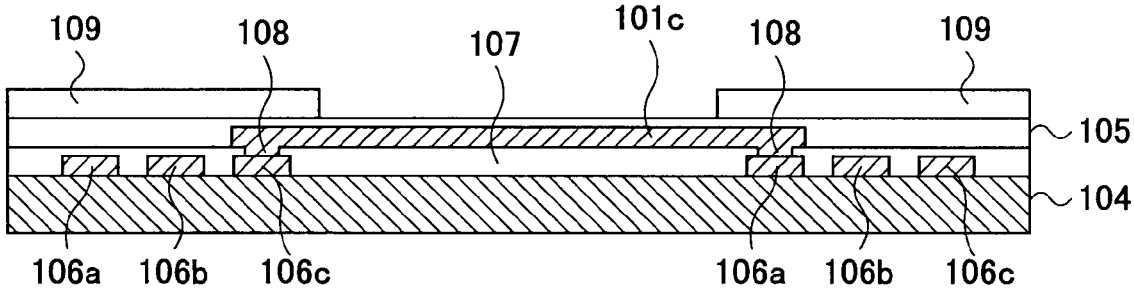
FIG. 9 is a cross-sectional view taken along line D-D' in FIG. 5.

In the following, a structure of the conveying base in the development device according to the first embodiment is described in detail with reference to FIGS. 5 to 9. FIG. 5 is a plan view showing the conveying base. FIG. 6 is a cross-sectional view taken along line A-A' in FIG. 5. FIG. 7 is a cross-sectional view taken along line B-B' in FIG. 5. FIG. 8 is a cross-sectional view taken along line C-C' in FIG. 5. FIG. 9 is a cross-sectional view taken along line D-D' in FIG. 5.

As shown in FIG. 6, in the conveying base 102 of the development device 100 according to the present embodiment, three conveying electrodes 101*a*, 101*b*, and 101*c* (these electrodes are referred to as the conveying electrodes 101) are disposed as one set repeatedly on a support base 104 at predetermined intervals along a toner conveying direction indicated by an arrow shown in FIG. 6 and in a direction substantially orthogonal to the toner conveying direction. The conveying base 102 constitutes an insulative conveying surface forming member for forming a conveying surface on the conveying electrodes 101 and becomes a protection film for covering a surface of the conveying electrodes 101. The conveying base 102 is made by laminating a surface protection layer 105 formed using inorganic or organic insulating materials. In this case, although the surface protection layer 105 forms the conveying surface, a surface layer may be separately formed further on the surface protection layer 105 in which compatibility with powder (toner) is superior.

On both sides of the conveying electrodes 101*a*, 101*b*, and 101*c*, common electrodes 106*a*, 106*b*, and 106*c* (these electrodes are referred to as common electrodes 106) connected to each of the conveying electrodes 101*a*, 101*b*, and 101*c* at both ends of the common electrodes 106 are disposed along the toner conveying direction, namely, in a direction substantially orthogonal to each of the conveying electrodes 101*a*, 101*b*, and 101*c*. In this case, a width of the common electrodes 106 (width in the direction orthogonal to the toner conveying direction) is wider than a width of the conveying electrodes 101 (width in the direction along the toner conveying direction). In addition, in FIG. 5, the common electrodes 106 are described separately as common electrodes 106*a*1, 106*b*1, and 106*c*1 in the conveying area, common electrodes 106*a*2, 106*b*2, and 106*c*2 in the development area, and common electrodes 106*a*3, 106*b*3, and 106*c*3 in the collection area.

In the present embodiment, as shown in FIGS. 7 to 9, after patterns of the common electrodes 106*a*, 106*b*, and 106*c* are formed on the support base 104, an interlayer insulation film 107 is formed, and then a contact hole 108 is formed on the interlayer insulation film 107. Thereafter, the conveying electrodes 101*a*, 101*b*, and 101*c* are formed, so that the conveying electrodes 101*a*, 101*b*, and 101*c* and the common electrodes 106*a*, 106*b*, and 106*c* are interconnected respectively. In addition, the interlayer insulation film 107 may be made of the same materials or different materials from the surface protection layer 105. Further, the interlayer insulation film 107 may be formed on a pattern integrally formed with the conveying electrode 101*a* and the common electrode 106*a*, a pattern integrally formed with the conveying electrode 101*b* and the common electrode 106*b* may be formed on the interlayer insulation film 107, and the interlayer insulation film 107 may be further formed thereon, so that it is possible to form a pattern where the conveying electrode 101*c* and the common electrode 106*c* are integrally formed on the interlayer insulation film 107. In other words, it is possible to have the electrodes in a three-layer structure or both integrated forming with interconnection using the contact hole 108.

Moreover, in the common electrodes 106*a*, 106*b*, and 106*c*, an input terminal (not shown in the drawings) for applying driving signals is disposed so as to input driving signals (driving waveforms) Va, Vb, and Vc from the driving circuit 103 of FIG. 4. The input terminal for applying driving signals may be disposed on a rear surface of the support base 104 and connected to each of the common electrodes 106 via a through hole or may be disposed on the interlayer insulation film 107.

As the support base 104, it is possible to use a glass base, a base made of insulating materials such as a resin base, a ceramics base, or the like, a base made of conductive materials such as SUS on which an insulating film such as $SiO_2$ and the like is formed, and a base made of materials capable of flexible deformation such as a polyimide film.

The conveying electrodes 101 are made by forming a film of conductive materials such as Al, Ni—Cr, or the like with a thickness of 0.1 to 10 μm, preferably, 0.5 to 2.0 μm on the support base 104 and forming a pattern of a required electrode shape using a photolithographic technique and the like. The width L of the plural conveying electrodes 101 in the movement direction of powder is within a range from not less than one time to not more than 20 times an average particle diameter of powder to be moved and a space of the conveying electrodes 101 in the movement direction of powder is also within a range from not less than one time to not more than 20 times the average particle diameter of powder to be moved.

Moreover, as the surface protection layer 105, for example, a film of $SiO_2$, $TiO_2$, $TiO_4$, SiON, BN, TiN, $Ta_2O_5$, $ZrO_2$, $BaTiO_3$, and the like is formed with a thickness of 0.5 to 10 μm, preferably, 0.5 to 3 μm. Further, inorganic nitrides such as SiN, BN, and the like may be used. In particular, when surface hydroxyl is increased, the amount of charge of the charged toner is likely to be reduced while being conveyed, so that inorganic nitrides having a small amount of surface hydroxyl (SiOH, silanol group) is preferably used.

The following describes a principle of electrostatic conveying of toner in the conveying base constructed in this manner. When n-phase (n is positive integer not less than 2) driving waveforms are applied to the plural conveying electrodes 101 of the conveying base 102, a phase electric field (progressive-wave electric field) is generated by the plural conveying electrodes 101 and the toner charged on the conveying base 102 receives repulsive force and/or attractive force, so that the toner moves in the movement direction while hopping and being conveyed.

Figure 10:
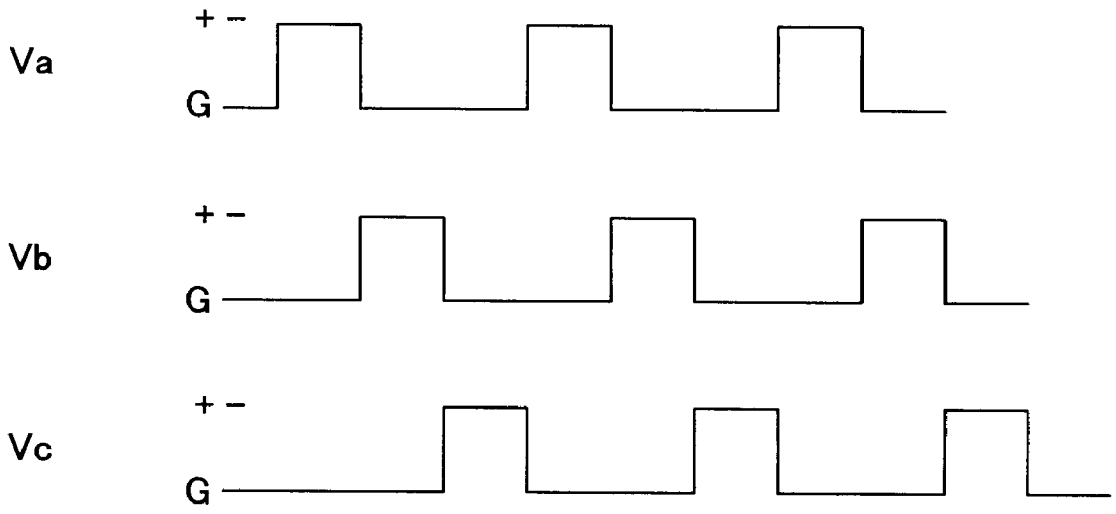
FIG. 10 is a waveform diagram showing an example of driving waveforms applied to a conveying base.

For example, as shown in FIG. 10, three-phase pulse-like driving waveforms (driving signals) A (phase A), B (phase B), and C (phase C) changing between a ground G (0V) and a positive voltage + are applied to the plural conveying electrodes 101 of the conveying base 102 at different times.

Figure 11:
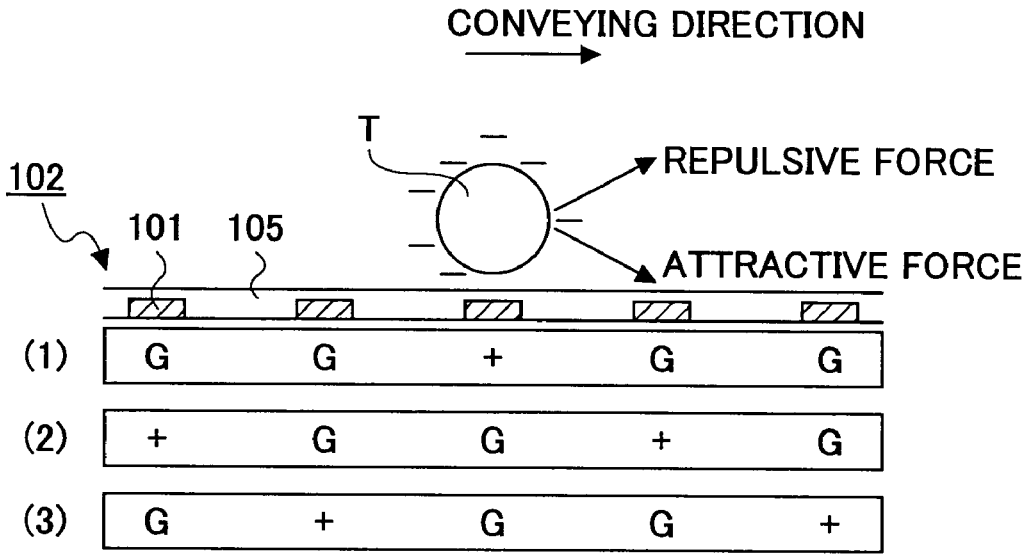
FIG. 11 is a schematic diagram showing how powder is conveyed while hopping.

In this manner, as shown in FIG. 11, while negatively charged toner T is on the conveying base 102, when "G", "G", "+", "G", and "G" are applied to the successive plural conveying electrodes 101 of the conveying base 102 as shown in (1) of FIG. 11, the negatively charged toner T is positioned above the "+" conveying electrodes 101.

At the next timing, "+", "G", "G", "+", and "G" are applied to the plural conveying electrodes 101 as shown in (2) of FIG. 11. The negatively charged toner T receives repulsive force from a left conveying electrode 101 having "G" and attractive force from a right conveying electrode 101 having "+", so that the negatively charged toner T moves to the right conveying electrode 101 having "+". Further, at the following timing, "G", "+", "G", "G", and "+" are applied to the plural conveying electrodes 101 as shown in (3) of FIG. 11. The negatively charged toner T receives repulsive force and attractive force in the same manner, so that the negatively charged toner T further moves to the right conveying electrode 101 having "+".

In accordance with this, by applying plural-phase driving waveforms with changing voltage to the plural conveying electrodes 101, a progressive-wave electric field is generated on the conveying base 102, so that the negatively charged toner T moves in a movement direction of the progressive-wave electric field while hopping and being conveyed. In addition, when the toner T is positively charged, the positively charged toner moves in the same direction in the same manner by reversing the above-mentioned pattern for changing the driving waveforms.

Figure 12:
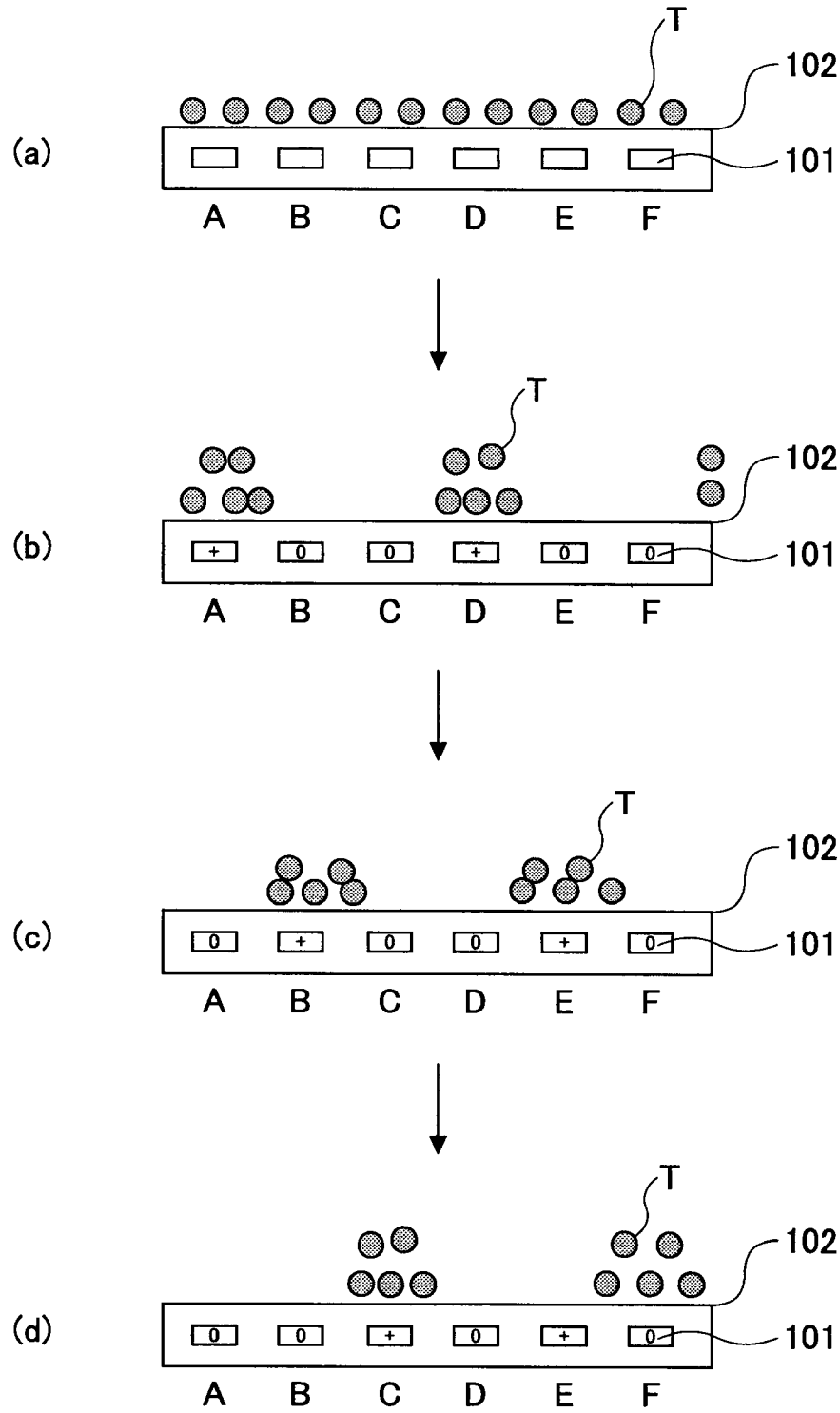
FIG. 12 is a schematic diagram showing a specific example of how powder is conveyed while hopping.

Specifically, how the toner T is conveyed is described with reference to FIG. 12. As shown in FIG. 12-(*a*), while the negatively charged toner T is on the conveying base 102 and the conveying electrodes A to F of the conveying base 102 have 0V (G), when "+" is applied to the conveying electrodes A and D as shown in FIG. 12-(*b*), the negatively charged toner T is attracted to the conveying electrode A and the conveying electrode D and moves onto the conveying electrodes A and D. At the next timing, as shown in FIG. 12-(*c*), when the conveying electrodes A and D have "0" and "+" is applied to the conveying electrodes B and E, the toner T on the conveying electrodes A and D receives repulsive force and attractive force from the conveying electrodes B and E, so that the negatively charged toner T is conveyed to the conveying electrode B and the conveying electrode E. Further, at the next timing, as shown in FIG. 12-(*d*), when the conveying electrodes B and E have "0" and "+" is applied to the conveying electrodes C and F, the toner on the conveying electrodes B and E receives repulsive force and attractive force from the conveying electrodes C and F, so that the negatively charged toner T is conveyed to the conveying electrode C and the conveying electrode F. In this manner, the negatively charged toner is successively conveyed in the right direction of FIG. 12 in accordance with the progressive-wave electric field.

Figure 13:
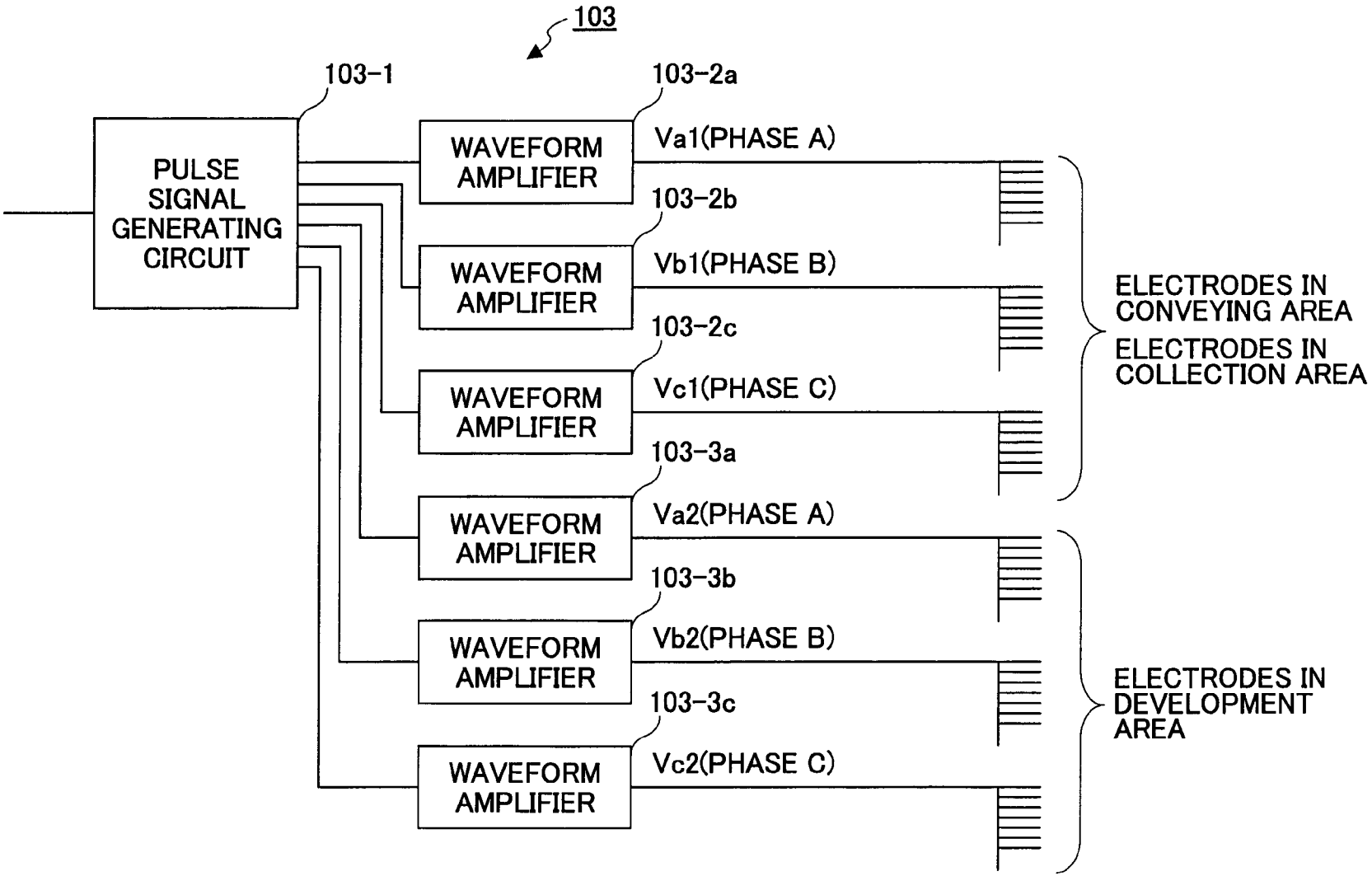
FIG. 13 is a block diagram showing an example of a driving circuit of FIG. 4.

The following describes an entire structure of a driving circuit of FIG. 4 with reference to FIG. 13. The driving circuit 103 includes a pulse signal generating circuit 103-1 for generating and outputting pulse signals, waveform amplifiers 103-2*a*, 103-2*b*, and 103-2*c* for receiving the pulse signals from the pulse signal generating circuit 103-1 and generating and outputting driving waveforms Va1, Vb1, and Vc1, and waveform amplifiers 103-3*a*, 103-3*b*, and 103-3*c* for receiving the pulse signals from the pulse signal generating circuit 103-1 and generating and outputting driving waveforms Va2, Vb2, and Vc2. The pulse signal generating circuit 103-1 receives a logic level input pulse, for example, and generates and outputs pulse signals of two groups of pulses each being phase-shifted by 120° having an output voltage of 10 to 15 V capable of 100 V switching by driving a switching unit (not shown in the drawings) such as a transistor included in the waveform amplifiers 103-2*a* to 103-2*c* and 103-3*a* to 103-3*c*.

Figure 14:
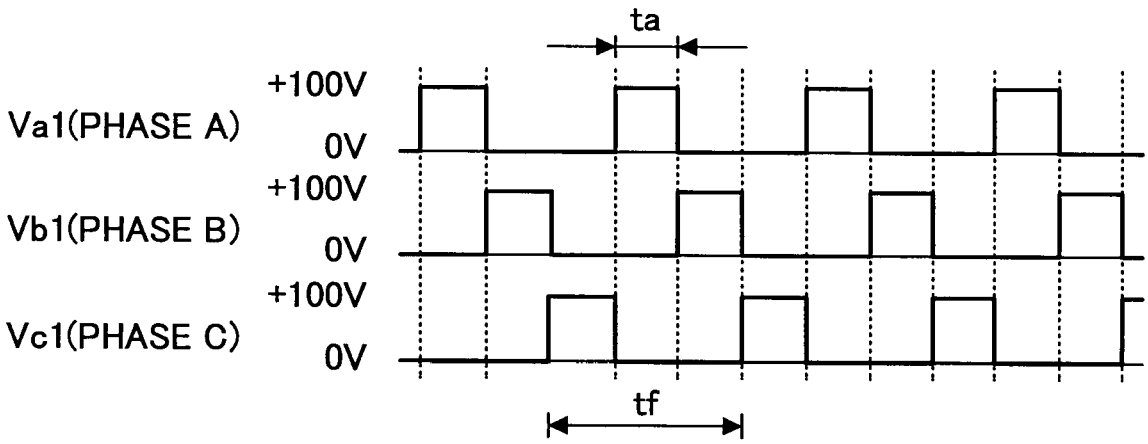
FIG. 14 is a time chart showing an example of driving waveforms of a conveying voltage pattern and a collection and conveying voltage pattern.
Figure 15:
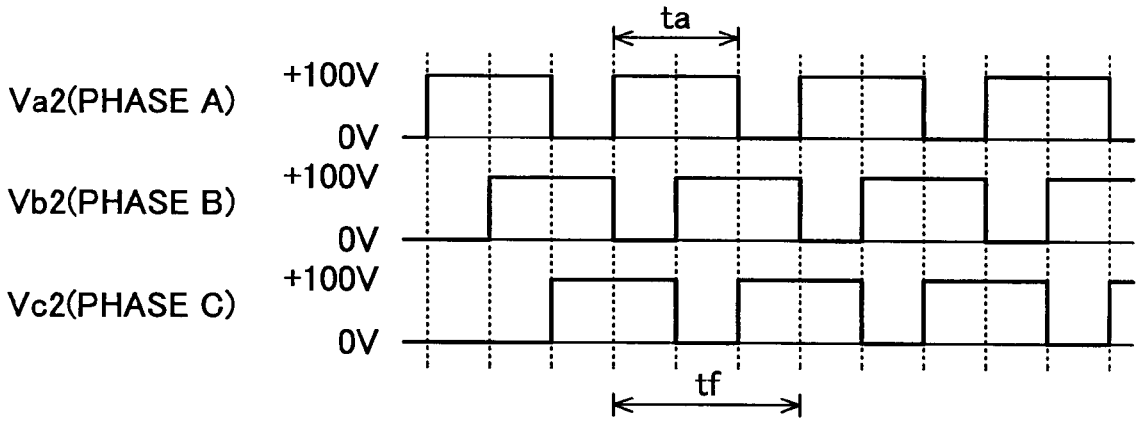
FIG. 15 is a time chart showing an example of driving waveforms of a hopping voltage pattern.

Moreover, the waveform amplifiers 103-2*a*, 103-2*b*, and 103-2*c* apply three-phase driving waveforms (driving pulses) Va1, Vb1, and Vc1 to each of the conveying electrodes 101 in the conveying area and each of the conveying electrodes 101 in the collection area of FIG. 4, in which an application time ta of +100 V for each phase is set to be about 33% as ⅓ of a repetition period tf (hereafter referred to as "conveying voltage pattern" or "collection conveying voltage pattern") as shown in FIG. 14, for example. Further, the waveform amplifiers 103-3*a*, 103-3*b*, and 103-3*c* apply three-phase driving waveforms (driving pulses) Va2, Vb2, and Vc2 to each of the conveying electrodes 101 in the development area of FIG. 4, in which an application time ta of +100 V or 0 V for each phase is set to be about 67% as ⅔ of the repetition period tf (hereafter referred to as "hopping voltage pattern") as shown in FIG. 15 or FIG. 16, for example.

As mentioned above, in the ETH, the toner is caused to be hopping, so that it is possible to perform reversal development of an electrostatic latent image on the latent image carrier using monocomponent development. In other words, in the development area, development is performed by a unit disposed for forming an electric field such that, in the development area, the toner is directed to the latent image carrier relative to the image area of the latent image and the toner is directed to the opposite side of the latent image carrier relative to the non-image area.

Figure 16:
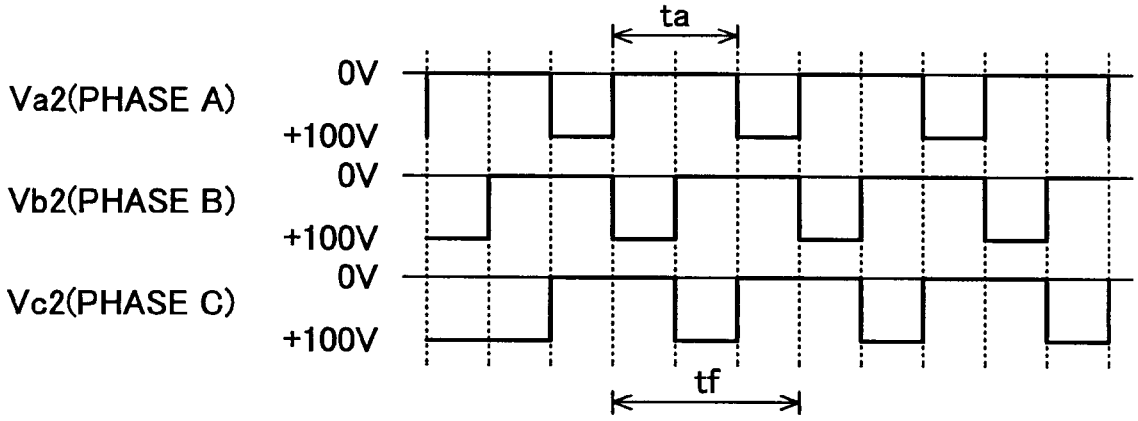
FIG. 16 is a time chart showing another example of driving waveforms of a hopping voltage pattern.

For example, in a case of pulse-like voltage waveforms changing from 0 to −100 V as the above-mentioned driving waveforms of hopping voltage patterns as shown in FIG. 16, when electric potential of the non-image area on the latent image carrier is less than −100 V, the toner is directed to the latent image carrier relative to the image area and the toner is directed to the opposite side of the latent image carrier relative to the non-image area. In this case, it is confirmed that the toner is directed to the latent image carrier when the electric potential of the non-image area of the latent image is −150 V or −170 V described later.

In a case where the driving waveforms of hopping voltage patterns are pulse-like voltage waveforms changing from 20 V to −80 V, when the electric potential of the image area is about 0 V and the electric potential of the non-image area is −110 V, the electric potential of a low level of the pulse-like driving waveforms is between the electric potential of the image area and the electric potential of the non-image area of the latent image, so that the toner is directed to the latent image carrier relative to the image area and the toner is directed to the opposite side of the latent image carrier relative to the non-image area in the same manner.

In other words, by setting the electric potential of the low level of the pulse-like driving waveforms between the electric potential of the image area and the electric potential of the non-image area of the latent image, it is possible to prevent the toner from being attached to the non-image area and perform high-quality development.

In this manner, in the ETH, the toner is attracted and attached to the image area of the latent image because of the hopping of the toner and the toner is repelled and unattached in the non-image area, so that it is possible to develop the latent image using the toner. In this case, it is possible to readily convey the hopping toner to the latent image carrier since no attractive force is generated with the conveying base, so that it is possible to perform high-quality development in a low voltage.

In other words, in a conventional what is called toner projection development, applied voltage exceeding adhesion of the toner to the development roller is necessary so as to separate the charged toner from the development roller and convey the toner to the photoconductor, so that a bias voltage of DC 600 to 900 V is required. By contrast, according to the present invention, although the adhesion of the toner usually ranges from 50 to 200 nN, the adhesion to the conveying base 102 becomes substantially 0 because the toner is hopping on the conveying base 102. Thus, the necessity of force to separate the toner from the conveying base 102 is eliminated and it is possible to sufficiently convey the toner to the latent image carrier in a low voltage.

Further, even when a voltage to be applied to each of the conveying electrodes 101 is a low voltage not mote than |150 to 100 |V, an electric field to be generated has a large value, so that it is possible to readily separate the toner attached to the surface of the conveying electrodes 101 and cause the toner to be projected or hopping. In addition, it is possible to substantially reduce or eliminate an amount of ozone or NOx generated when the photoconductor such as OPC is charged, so that the present invention is very advantageous in terms of environment issues and durability of the photoconductor.

In accordance with this, it is not necessary to have a high voltage bias of 500 V to several KV applied between the development roller and the photoconductor so as to separate the toner attached to the surface of the development roller or the surface of the carrier according to the conventional method, and it is possible to form and develop the latent image while the electric potential of the photoconductor is very low.

For example, when the OPC photoconductor is used and a thickness of CTL (Charge Transport Layer) on the surface is 15 μm, relative permittivity ∈ is 3, and charge density of the charged toner is (−3E-4C/m2, surface potential of OPC is about −170 V. In this case, when pulse-like driving voltages of 0 to −100 V having duty of 50% are applied as an applied voltage to the electrodes of the conveying base, an average is −50 V, so that an electric field between the electrodes of the conveying base and the OPC photoconductor has the relationship as mentioned above when the toner is negatively charged.

In this case, when a gap (space) between the conveying base and the OPC photoconductor is from 0.2 to 0.3 mm, development is sufficiently possible. Although the development depends on Q/M of the toner, a voltage applied to the electrodes of the conveying base, and a printing speed, namely, a rotation speed of the photoconductor, the development is sufficiently possible in the case of the negatively charged toner when an electric potential for charging the photoconductor is at least not more than −300 V or −100 V when development efficiency has priority. In a case of positive charge, the electric potential of the charged toner has positive potential.

The above-mentioned ETH performs development by causing the toner to be hopping on the conveying base so as to make the adhesion to the conveying base substantially 0. However, by merely causing the toner to be hopping on the conveying base, even when the hopping toner has progressive properties towards the latent image carrier, certainty of attaching to the latent image of the latent image carrier is not assured and toner is scattered.

In view of this, the present invention provides conditions in the ETH by which the hopping toner is securely adhered to the image area of the latent image of the latent image carrier in a selective manner without being adhered to the non-image area, namely, without causing scumming.

In other words, a relationship between the electric potential (surface potential) of the latent image of the latent image carrier and the electric potential (electric field to be generated) to be applied to the conveying base is set as a predetermined relationship so as to generate the electric field for directing the toner to the latent image carrier relative to the image area of the latent image of the latent image carrier and directing the toner to the conveying base relative to the non-image area as mentioned above. In accordance with this, the toner is securely attached to the image area of the latent image and the toner directed to the non-image area is repelled to the conveying base. Thus, the toner hopping on the conveying base is efficiently used for development and it is possible to prevent the scattering of toner and perform high-quality development through low-voltage driving.

In this case, by setting an average value of electric potential (average potential) applied to the conveying electrodes of the conveying base to be an electric potential between the electric potential of the image area and the electric potential of the non-image area of the latent image of the latent image carrier, it is possible to generate the electric field for directing the toner to the latent image carrier relative to the image area and directing the toner to the conveying base relative to the non-image area of the latent image of the latent image carrier as mentioned above.

Figure 17:
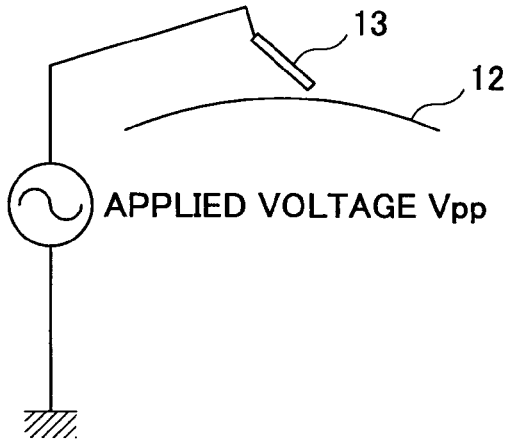
FIG. 17 is a schematic diagram showing how voltage is applied to a uniform hopping height adjusting member.
Figure 18:
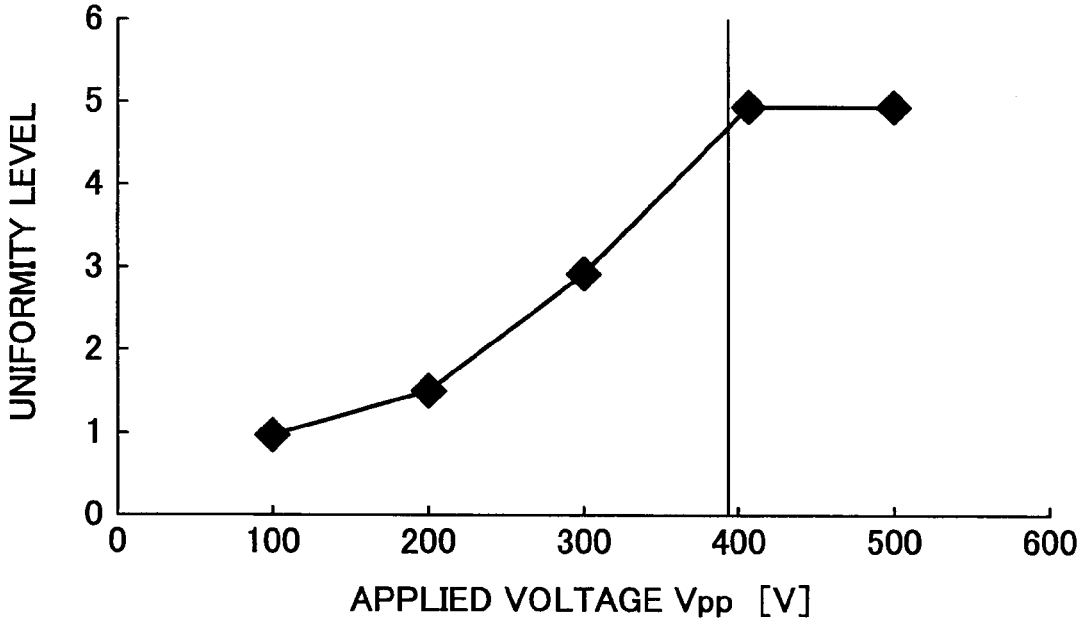
FIG. 18 is a diagram showing characteristics of a relationship between an AC voltage applied to a uniform hopping height adjusting member and effects on final uniformity when toner having a toner charge amount of about −20 μC/g is conveyed.

The following describes a case where AC is applied to the uniform hopping height adjusting member. As shown in FIG. 17, in at least 10 mm of the conveying direction in the conveying area of the conveying member 12, a gap between the uniform hopping height adjusting member 13 and the conveying base is set within a range from 0.12 to 0.24 mm (value is changed in accordance with a presumed hopping height), such that a hopping height is set to be at least about 80% of the presumed hopping height ranging from 150 to 300 μm. Thus, 60 to 90% of the hopping toner is controlled in accordance with the height of the uniform hopping height adjusting member 13, so that a uniform height is obtained for a toner cloud layer. When a voltage of negative polarity (about 50 to 300 V) is applied to the uniform hopping height adjusting member 13, effects of control are further increased and the uniformity of the toner cloud layer is improved. This applied voltage is related to the amount of charge of the toner, the applied voltage $V_{pp}$, frequency, and the like upon conveying the toner and it is possible to obtain the uniformity by adjusting these values as appropriate. FIG. 18 is a diagram showing characteristics of a relationship between an AC voltage applied to the uniform hopping height adjusting member and effects on final uniformity when toner having a toner charge amount of about −20 μC/g is conveyed. As shown in FIG. 18, according as $V_{pp}$ is increased, the uniformity is improved. This is due to the fact that when the toner is reciprocating up and down from the effects of the AC electric field, the hopping is assisted and intensity is increased. In addition, the hopping is also regulated by the uniform hopping height adjusting member, so that the uniformity of the height of the toner cloud layer is further improved. In the present embodiment, square waves of 3 [kHz] are applied.

On the other hand, these facts result from a difference of hopping height due to the toner being conveyed having a charge amount distribution. Toner of high distribution has a relatively high charge amount and the intensity of an electric field affecting the toner is considered to be increased relative to the voltage applied to the conveying electrodes. Although toner of low distribution has a relatively low charge amount, the voltage applied to the uniform hopping height adjusting member affects the toner having high distribution and the relatively high charge amount, so that the height is controlled to be reduced. And, the height of the toner having the relatively low charge amount is controlled to be increased, so that unevenness of height is reduced and it is possible to have a uniform electric potential especially for the toner cloud.

Figure 19:
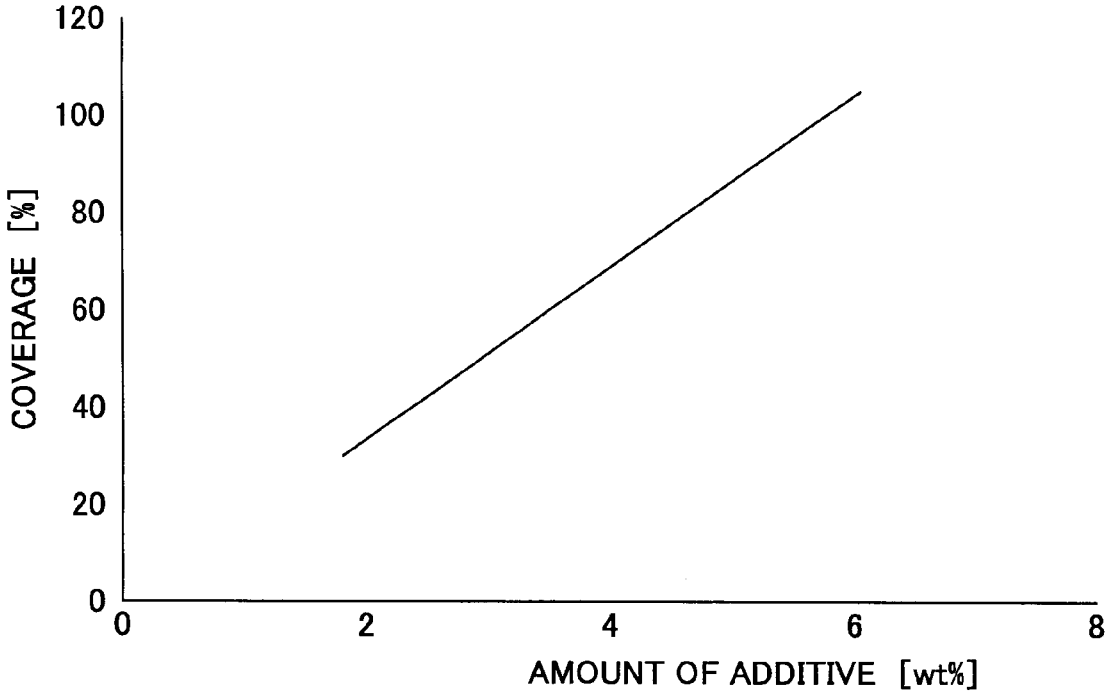
FIG. 19 is a diagram showing characteristics of a relationship between an amount of additive for toner and coverage.
Figure 20:
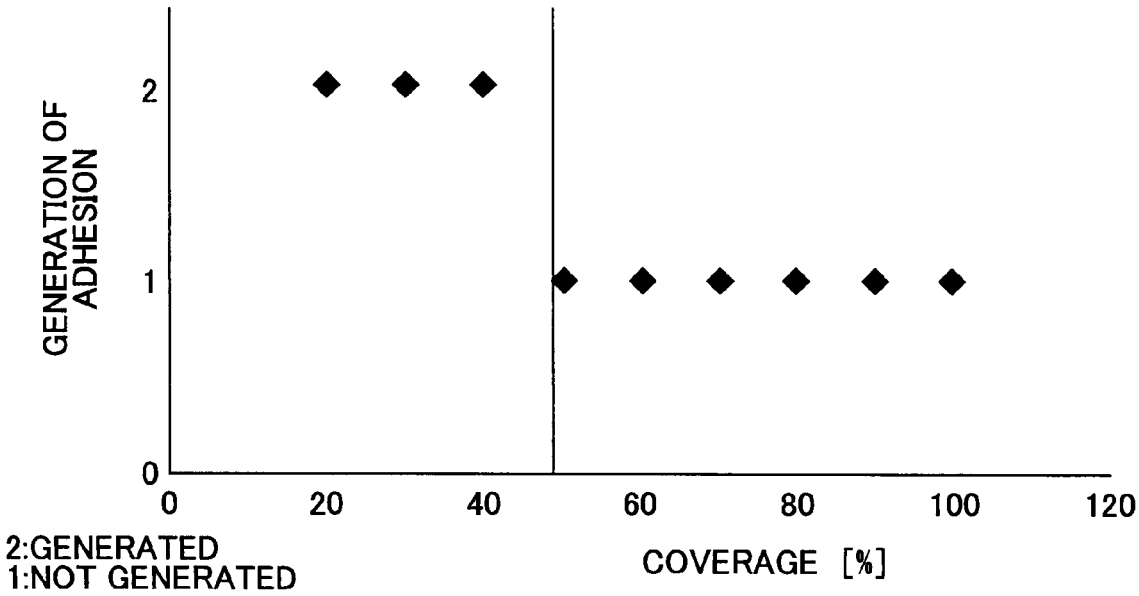
FIG. 20 is a diagram showing characteristics of a relationship between coverage and adhesion upon conveying.

Further, although the toner to be used is coated with additive so as to have fluidity, an experience of isolated toner reveals that unevenness of conveying is generated when coverage of the additive is not more than a certain value and it is impossible to convey the toner when the coverage is further reduced. FIG. 19 is a diagram showing characteristics of a relationship between an amount of the additive for the toner and the coverage. FIG. 20 is a diagram showing characteristics of a relationship between the coverage and adhesion upon conveying. In this case the coverage Tn is calculated in accordance with the following formula:

$$Tn=100C\cdot\sqrt{3}/\{2\pi(100-C)(1+r/R)^2(r/R)(\rho r/\rho c)\}$$

where R: radius of the toner, r: radius of the additive, and C: wt % of the additive relative to the toner.

As shown in FIGS. 19 and 20, it is possible to reduce adhesion of the toner to the conveying member by having the coverage not less than a certain value. By combining the air flow and the toner in this status, it is possible to improve the fluidity and stabilize conveying in accordance with the effects of air ejection upon starting even when disturbance is generated in terms of environment or the like.

The following describes a case where the uniform hopping height adjusting member is constituted using a material having flexibility and oscillated, so that a conveying status is stabilized and the toner cloud layer becomes uniform.

Figure 21:
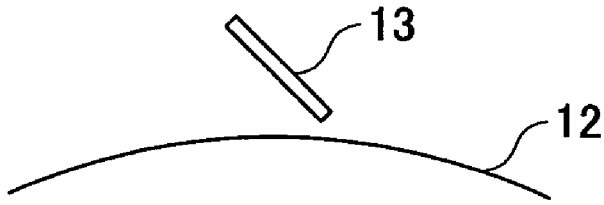
FIG. 21 is a schematic diagram showing a development device of the present invention.

As shown in FIG. 21 in at least 10 mm of the conveying direction in the conveying area, a gap between the uniform hopping height adjusting member and the conveying base is set within the range from 0.12 to 0.24 mm (value is changed in accordance with a presumed hopping height) in the same manner as in the above-mentioned embodiment, such that the hopping height is set to be at least about 80% of the presumed hopping height ranging from 150 to 300 μm.

In this case, the uniform hopping height adjusting member is formed using a material having flexibility. Examples of such a material include rubber materials such as silicon, butadiene, NBR, hydrin, EPDM, and the like. It is possible to use these rubber materials when conductive agent such as carbon black is dispersed and resistance is adjusted. Depending on hardness, when a thickness of the uniform hopping height adjusting member is within a range from several tens of μm to 2 mm, impact of collision of the toner hopping from the conveying electrodes is absorbed and speed is reduced, so that it is possible to have uniform distribution of the height of the toner cloud layer. Preferably, the hardness of the materials ranges from about 10 degrees to 35 degrees in Asker C. When the hardness is less than 10 degrees, plasticizer is likely to bleed and a possibility of reacting to the toner and fixing is increased. When the hardness exceeds 35 degrees, the materials are unable to absorb the impact of the collision and the toner is repulsed with high elasticity, so that a possibility of colliding with other toner is increased. In accordance with this, disturbance in the toner cloud layer is accelerated.

Figure 22:
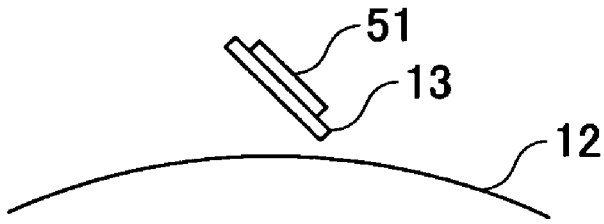
FIG. 22 is a diagram showing an example of a uniform hopping height adjusting member on which an oscillating element is disposed.

Moreover, as shown in FIG. 22, an oscillating element 51 is disposed on a backside of the uniform hopping height adjusting member 13 and oscillated. In other words, the oscillating element 51 such as a piezo element or the like is attached to the backside of the uniform hopping height adjusting member 13 and a voltage of a specific frequency is applied to the oscillating element 51, so that oscillation is obtained and the oscillation affects the hopping toner. Thus, the repulsion is reduced and it is possible to have a uniform height for the toner cloud.

Figure 23:
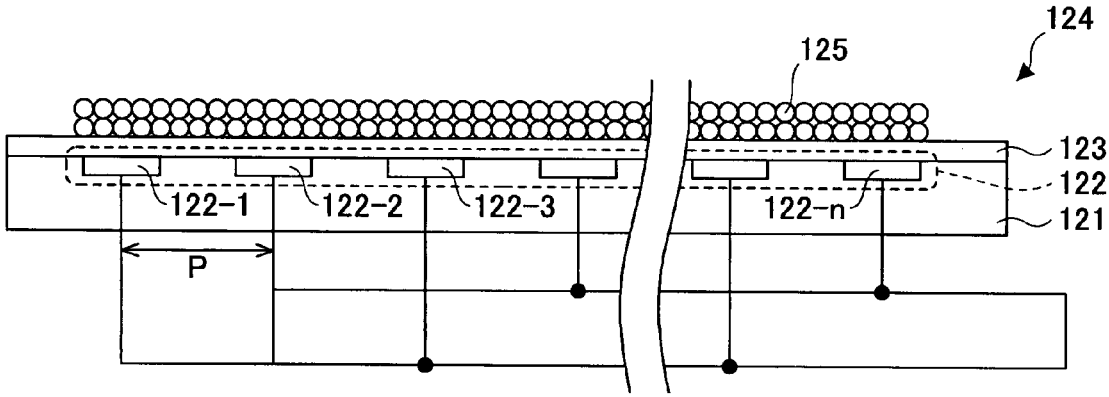
FIG. 23 is a cross-sectional view showing a system used for an experiment regarding the present invention.

The following describes a second embodiment of the present invention. As shown in FIG. 23, aluminum is deposited on a glass base 121 and an electrode pattern 122 is formed in which plural electrodes 122-1, 122-2, 122-3 . . . are arranged in the movement direction at a pitch of p [μm]. On the electrode pattern 122, a protection layer 123 coated with resin having a thickness of about 3 [μm] and volume resistivity of about $10^{10}$ [Ω·cm] is formed, thereby constructing a base 124. A charged toner layer 125 is formed on the base 124.

Figure 24:
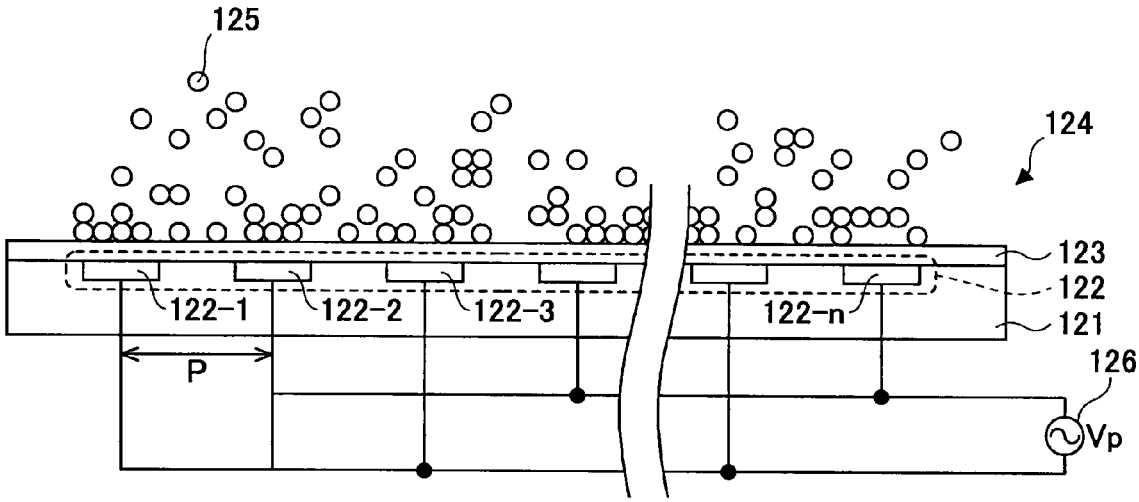
FIG. 24 is a cross-sectional view showing a status of flare of a system used for an experiment regarding the present invention.

The charged toner layer 125 is formed by developing a solid image into a thin layer on the base 124 using a two-component development unit not shown in the drawings. The toner used in this case is polyester having a particle diameter of about 6 [μm] and a toner charge amount of about −22 [μC/g] when formed on the base 124 into the thin layer. As shown in FIG. 24, while an alternating voltage is applied from an alternating-current power supply 126 to an odd number electrode group as a collection of odd number electrodes 122-1, 122-3 . . . , when an alternating voltage in opposite phase relative to the above-mentioned alternating voltage is applied to an even number electrode group as a collection of even number electrodes 122-2 . . . , the toner 125 moves between the odd number electrode group including the electrodes 122-1, 122-3 . . . and the even number electrode group including the electrodes 122-2 . . . in a reciprocating manner. In the following, this phenomenon is referred to as flare (or a flare phenomenon). A status where such a flare phenomenon is caused is referred to as a flare status.

Figure 25:
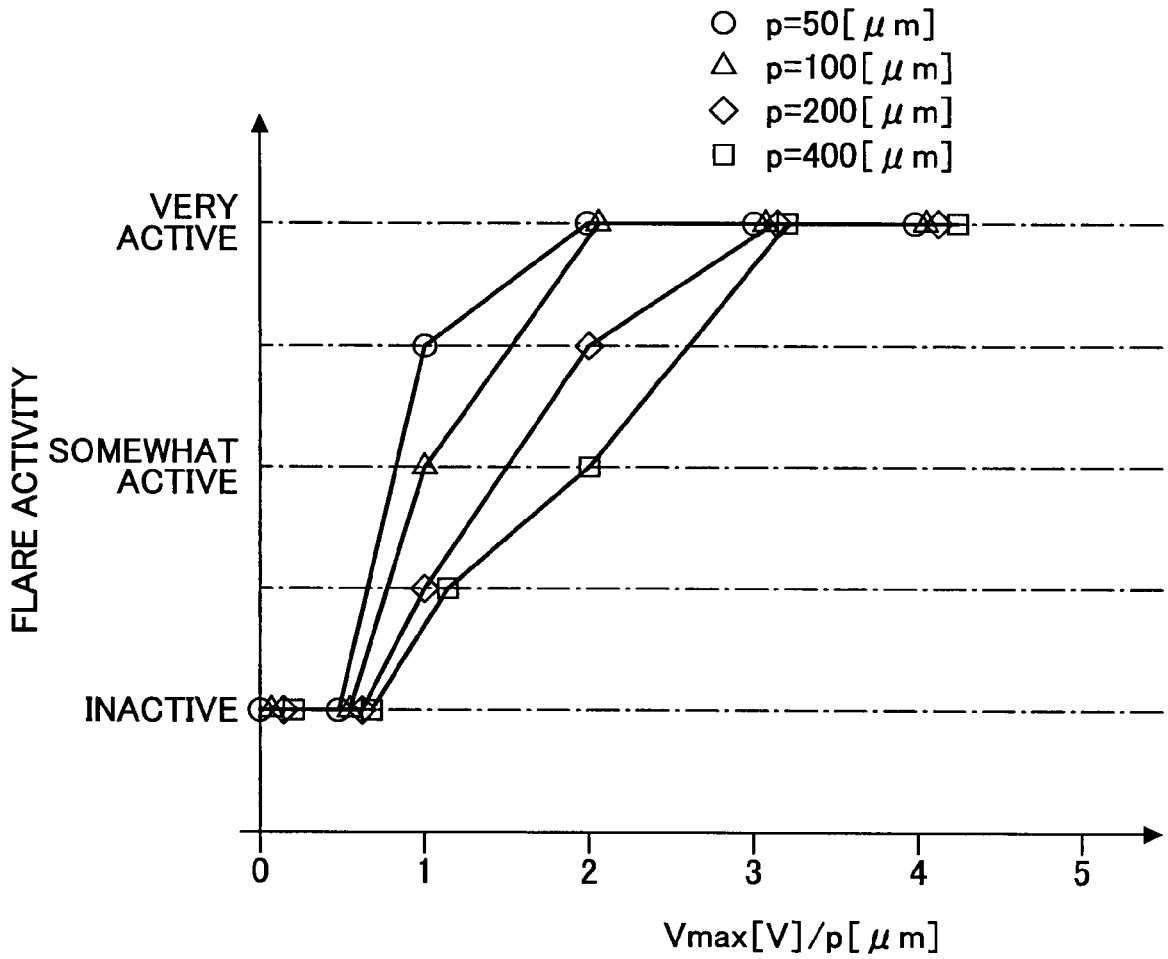
FIG. 25 is a diagram showing characteristics of a relationship between Vmax[V]/p[μm] and flare activity as an experimental result of a system used for an experiment regarding the present invention.

A result as shown in FIG. 25 is obtained when activity of flare is observed through a high-speed camera using four types of bases 124 each having a pitch p of the electrodes 122-1, 122-2, 122-3 . . . as 50, 100, 200, and 400 [μm] and specifying (changing) a Vmax [V] to several points as an absolute value of a difference between a plus peak value and a minus peak value of the alternating voltage applied from the alternating-current power supply 126 to the electrodes 122-1, 122-2, 122-3 . . . . A width of the electrodes 122-1, 122-2, 122-3 . . . and a distance between the adjacent electrodes 122-1, 122-2, 122-3 . . . are configured to be ½ of the pitch of the electrodes 122-1, 122-2, 122-3 . . . .

In this case, the activity of flare is obtained from sensory evaluation of five grades by observing the toner adhered and stationary on a surface of the base 124. From FIG. 25, it is confirmed that the activity of flare is obtained in accordance with Vmax[V]/p[μm] regardless of values of Vmax and pitch p. When Vmax[V]/p[μm]>1, the flare becomes activated and when Vmax[V]/p[μm]>3, the flare is completely activated.

Figure 26:
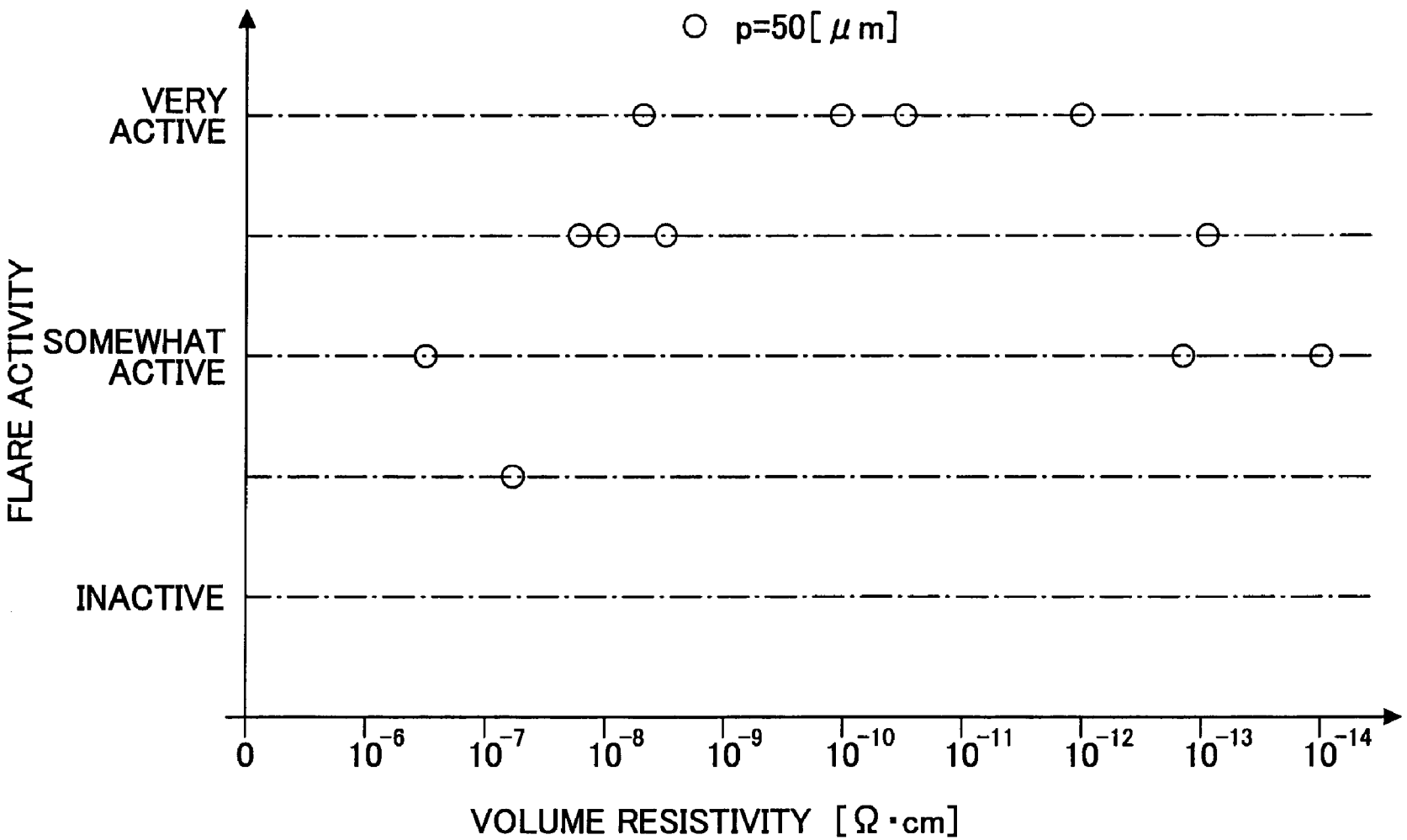
FIG. 26 is a diagram showing characteristics of a relationship between volume resistivity of a surface layer and flare activity as an experimental result of a system used for an experiment regarding the present invention.

Moreover, volume resistivity of the surface layer 123 of the base 124 is specified (changed) to several points and the flare activity is confirmed in the same manner. A material used for the surface layer 123 is silicone resin and the protection layer 123 (thickness is about 5 [μm]) with a volume resistivity of $10^7$ to $10^{14}$ [Ω·cm] is formed by changing an amount of carbon particles dispersed therein. When the protection layer 123 having a pitch p of 50 [μm] for the electrodes 122-1, 122-2, 122-3 . . . is used and the same experiment as mentioned above is conducted, a result shown in FIG. 26 is obtained.

From this result, it is confirmed that the volume resistivity of the surface layer 123 is preferably within a range from $10^9$ to $10^{12}$ [Ω·cm]. This is because when the surface layer 123 with a very high volume resistivity is used, the surface of the base 124 remains charged due to friction between toner repeatedly projected and the surface layer 123. In accordance with this charge, surface potential of the base 124 is fluctuated, so that bias contributing to development is made unstable. By contract, when conductivity of the surface layer 123 is very high, a leak of electric charge (short circuit) is generated between the electrodes 122-1, 122-2, 122-3 . . . , so that efficient bias effects are not obtained. The protection layer 123 is required to have suitable resistivity ($10^9$ to $10^{12}$ [Ω·cm] in volume resistivity) so as to successfully flow electric charge stored on the surface of the base 124 to a group of electrodes 122-1, 122-2, 122-3 . . . . This optimum range of volume resistivity is obtained from an experiment in which experimental equipment provided with a device shown in FIG. 24 is used. Instead of the device shown in FIG. 24, when a development roller (described in detail later) shown in FIG. 33 described later is disposed on a development device, the optimum range of this development device may be different from that of the above-mentioned development device. In this case, preferably, the optimum range of the volume resistivity in the development device is examined through an experiment and adjusted to have a suitable volume resistivity.

Figure 27:
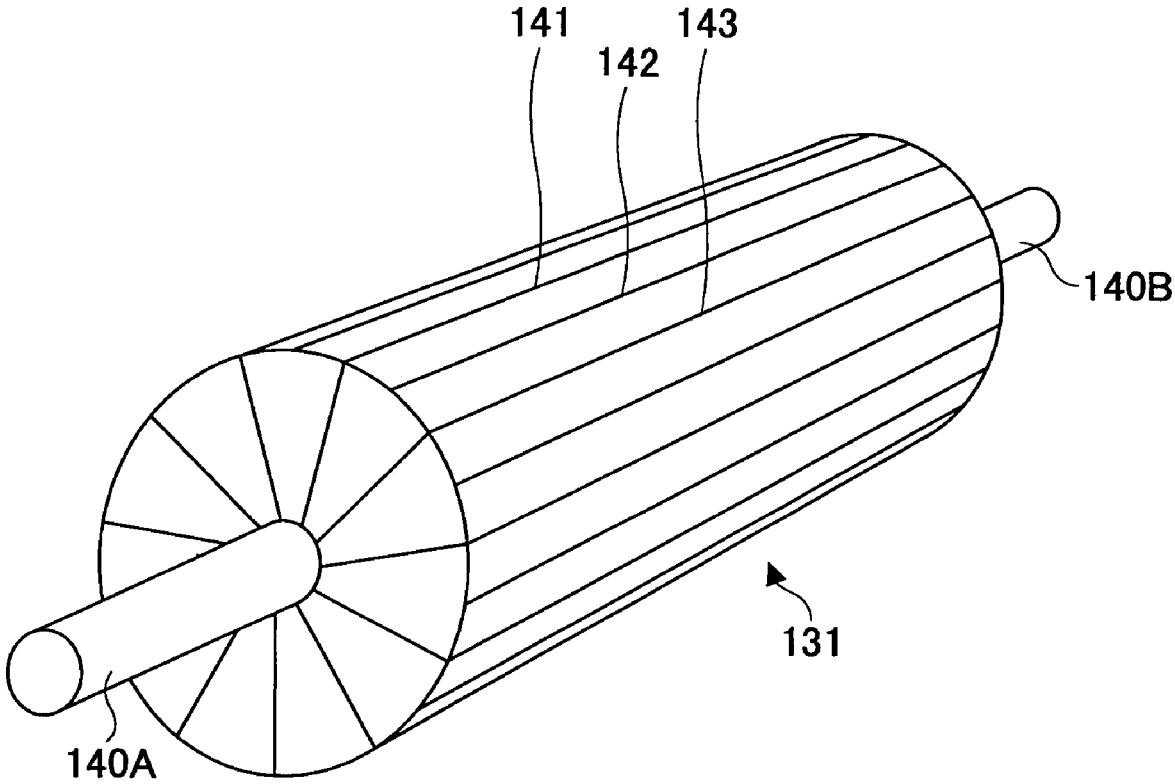
FIG. 27 is a schematic diagram showing a typical example of a toner carrier in an image forming apparatus according to a second embodiment of the present invention.

FIG. 27 is a schematic diagram showing a typical example of a toner carrier in an image forming apparatus according to the second embodiment of the present invention. A toner carrier 131 is formed into a rotation roller shape and is capable of rotating on an electrode shaft 140A including bundled electrodes of the odd number electrode group as a collection of odd number electrodes and on an electrode shaft 140B including bundled electrodes of the even number electrode group as a collection of even number electrodes in the electrode pattern arranged with a spatial period at a pitch of p [μm] in the movement direction made of plural electrodes 141, 142, 143 . . . . An alternating voltage is applied to each of the electrode shaft 140A and the electrode shaft 140B as a bias potential from the alternating-current power supply by an electrode brush or the like not shown in the drawings.

Figure 28:
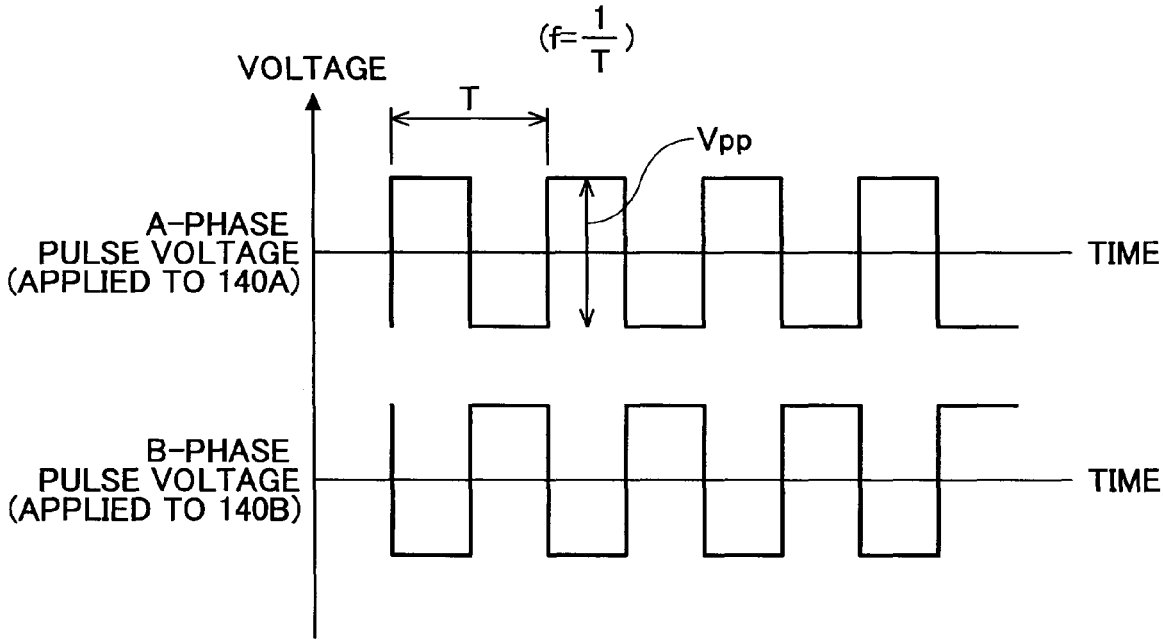
FIG. 28 is a waveform diagram showing characteristics of an A-phase pulse voltage and a B-phase pulse voltage applied to electrodes of a toner carrier.
Figure 29:
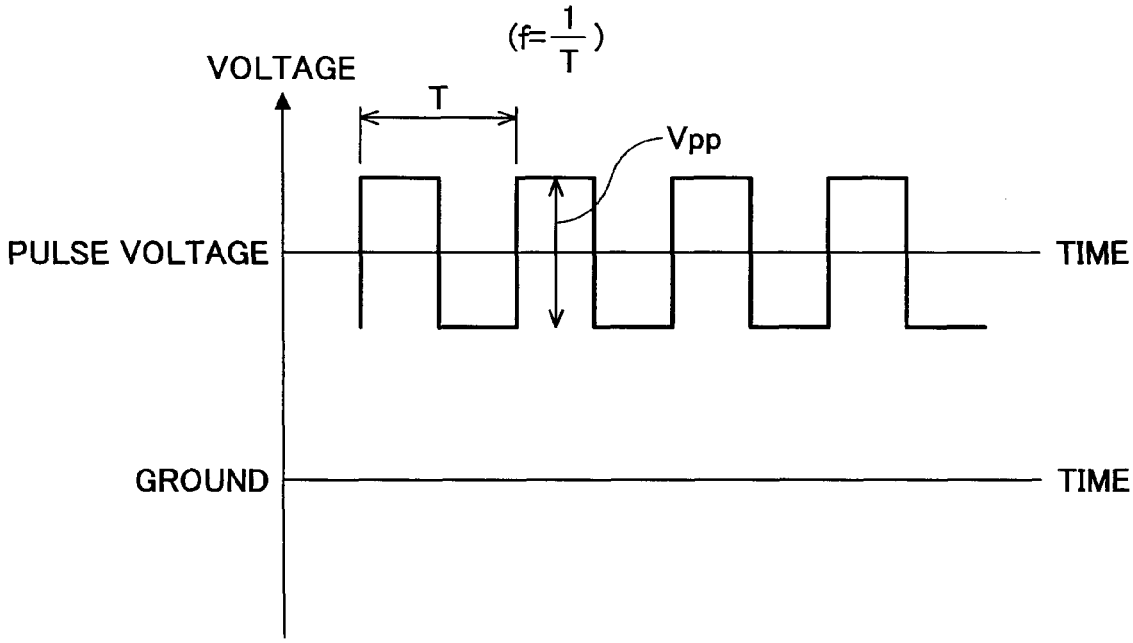
FIG. 29 is a waveform diagram showing a conventional application method.

As shown in FIG. 28, the alternating voltage includes an A-phase pulse voltage of square waves applied to the above-mentioned electrode shaft 140A including the bundled electrodes of the odd number electrode group and a B-phase pulse voltage of square waves applied to the above-mentioned electrode shaft 140B including the bundled electrodes of the even number electrode group. These A-phase pulse voltage and B-phase pulse voltage have phases opposite to each other as shown in FIG. 28 and an average potential (center of amplitude) per unit time is the same in both voltages. This average potential corresponds to a development bias in monocomponent development and two-component development. In these two-phase pulse voltages, in a first half and a latter half of one cycle T, a potential difference which is the same as amplitude (Vpp) of a pulse voltage is generated between the odd number electrode (one of an electrode pair) and the even number electrode (the other of the electrode pair). In accordance with this, a desired potential difference is generated between both electrodes from a pulse voltage of smaller amplitude (Vpp) in comparison with an application method of FIG. 29 generating a potential difference of only half of the amplitude. Thus, it is possible to reduce generation of scumming as compared with the conventional application method.

Although the above-mentioned example is described based on a case where pulse voltages in opposite phase to each other are applied to the odd number electrode and the even number electrode, it is not necessary to have a completely opposite phase. Even if an amount of shift of the phase is not more than a half of the cycle, when the potential of one electrode is shifted to a plus side relative to the center of amplitude (Vpp) of a pulse voltage, it is possible to have the potential of the other electrode shifted to a minus side relative to the center. However, completely opposite phases are most efficient since a period of time when the potential difference between the electrodes is the same as the amplitude is longest.

Figure 30A:
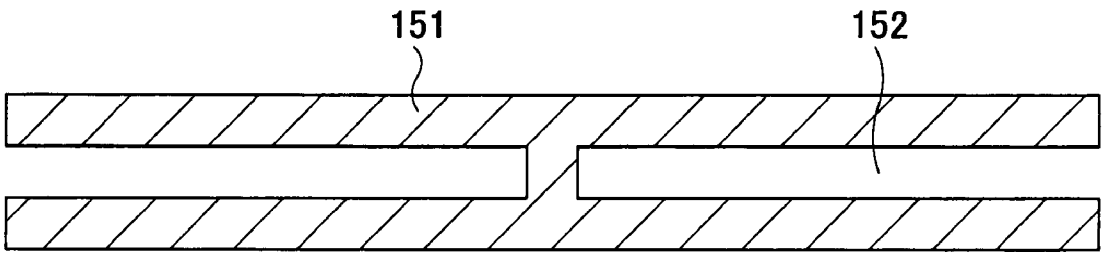
FIG. 30A is a cross-sectional view showing one step of a process for manufacturing a toner carrier.
Figure 30B:
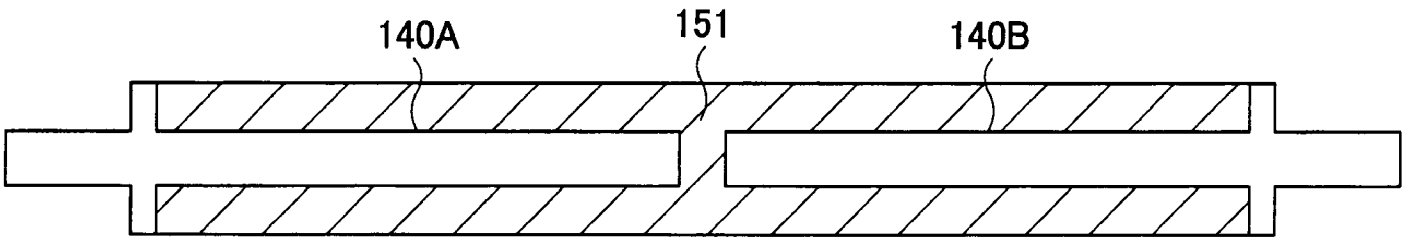
FIG. 30B is a cross-sectional view showing another step of a process for manufacturing a toner carrier.
Figure 30C:
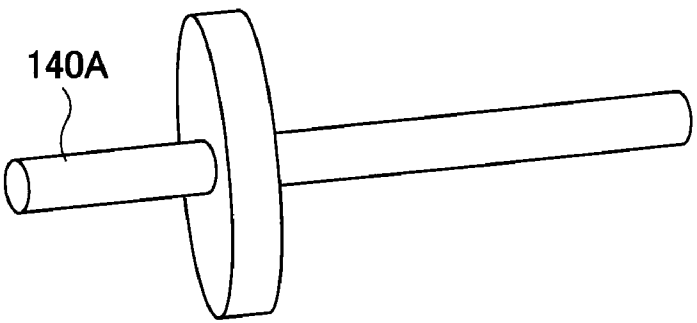
FIG. 30C is a perspective view showing a electrode shaft.
Figure 31:
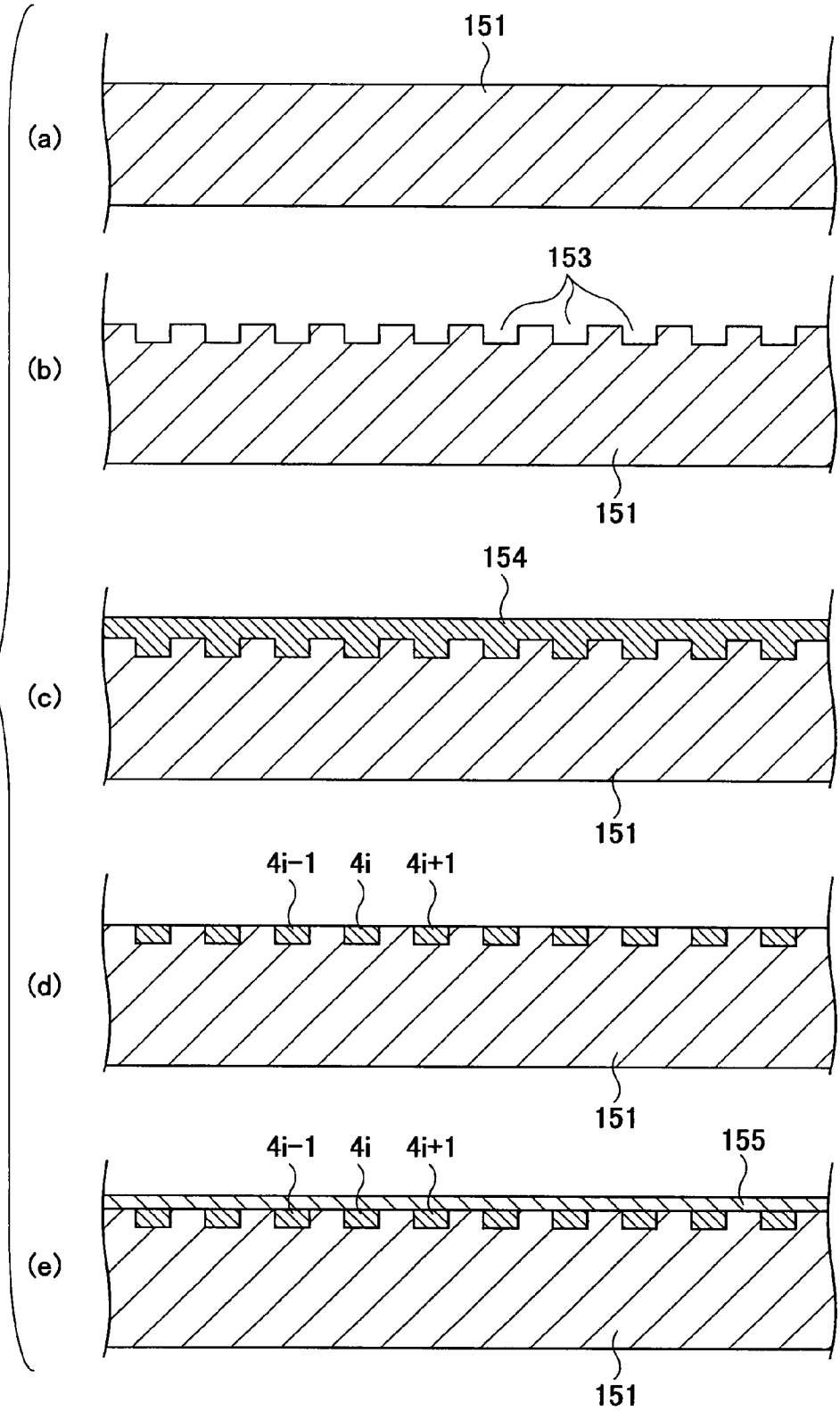
FIG. 31 is a cross-sectional view showing another step of a process for manufacturing a toner carrier.
Figure 32:
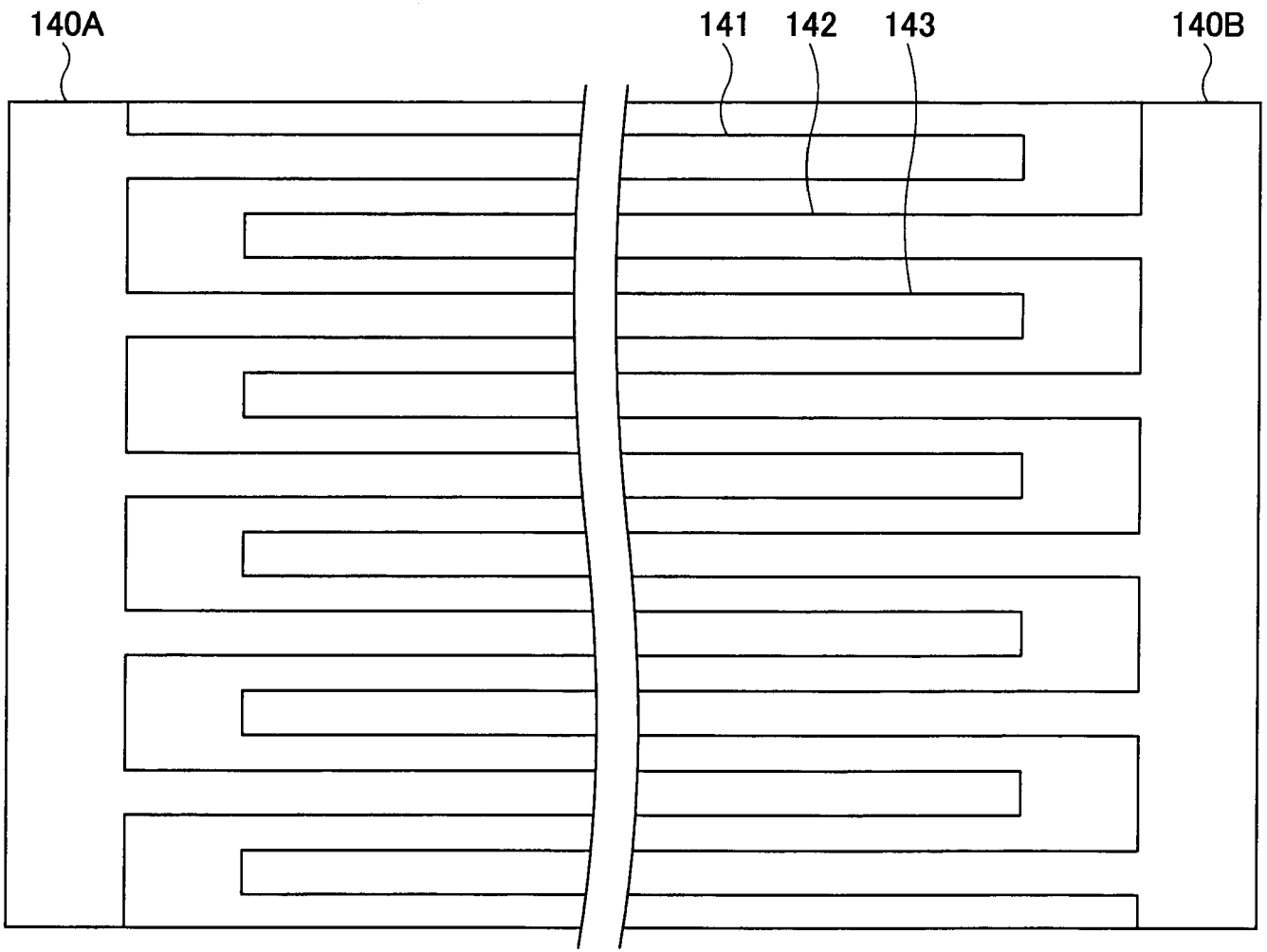
FIG. 32 is a development view showing a toner carrier when developed in a plane.

In the toner carrier 131, as shown in FIG. 30A, a shaft hole 152 is disposed on a cylinder 151 of acrylic resin as an insulator. Then, as shown in FIG. 30B, the electrode shafts 140A as shown in FIG. 30C and 140B made of stainless steel are pressed into the shaft hole 152 of the cylinder 151 and the electrode shafts 140A and 140B are connected to the odd number electrode group including the electrodes 141, 143 . . . and the even number electrode group including the electrodes 142 . . . , respectively. Thereafter, a pattern electrode is formed in each step shown in FIG. 31-(*a*) to 31-(*e*). FIG. 31-(*a*) to 31-(*e*) is a cross-sectional view showing a surface of the toner carrying roller 131 when viewed along the rotation shaft. In the step shown in FIG. 31-(*a*), a surface of the roller 151 obtained in the steps shown in FIG. 30A and FIG. 30B is finished to be smooth by turning a circumference of the roller 151. In the step shown in FIG. 31-(*b*), grooves 153 are formed by cutting the roller 151 such that a pitch of the grooves is 100 [μm] and a groove width is 50 [μm]. In the step shown in FIG. 31-(*c*), the roller 151 in which the grooves are formed is plated with electroless nickel 154. In the step shown in FIG. 31-(*d*), an unnecessary portion of a conductive film is removed by turning the circumference of the roller 151 plated with the electroless nickel 154. In this step, the electrodes 141, 142, 143 . . . are formed on the grooves 153 while being insulated from one another. Thereafter, the roller 151 is coated with silicone resin so as to make the surface of the roller 151 smooth and a surface protection layer 155 (thickness is about 5 [μm] and volume resistivity is about $10^{10}$ [Ω·cm]) is formed at the same time, thereby manufacturing the toner carrying roller 131. FIG. 32 is a development view showing a status of the toner carrying roller 131 when developed in a plane.

In the toner carrying roller 131, in the same manner as in the above-mentioned base 124, a thin toner layer is formed on the surface protection layer 155. When the alternating voltage shown in FIG. 28 is applied to the electrode shafts 140A and 140B as a bias potential from the alternating-current power supply not shown in the drawings via an electrode brush or the like, the toner moves between the odd number electrode group including the electrodes 141, 143 . . . and the even number electrode group including the electrodes 142 . . . in a reciprocating manner (flare). An absolute value of a difference between a plus peak value and a minus peak value of the alternating voltage applied from the alternating-current power supply to the electrodes 141, 142, 143 . . . is Vmax[V]. When Vmax[V]/p[μm]>1, the flare becomes activated and when Vmax[V]/p[μm]>3, the flare is completely activated. The toner carrying roller 131 is suitable in the same manner as in the base 124 when the volume resistivity of the surface protection layer 155 is within a range from $10^9$ to $10^{12}$ [Ω·cm]. The surface protection layer 155 is made of silicone resin. Preferably, materials of the surface protection layer 155 are substances capable of providing regular electric charges to toner through friction with toner as mentioned above. Examples of such materials preferably include glass and substances used for carrier coating of two-component developer. The pitch p is set to be smaller than a development gap d, namely, p<d.

Figure 33:
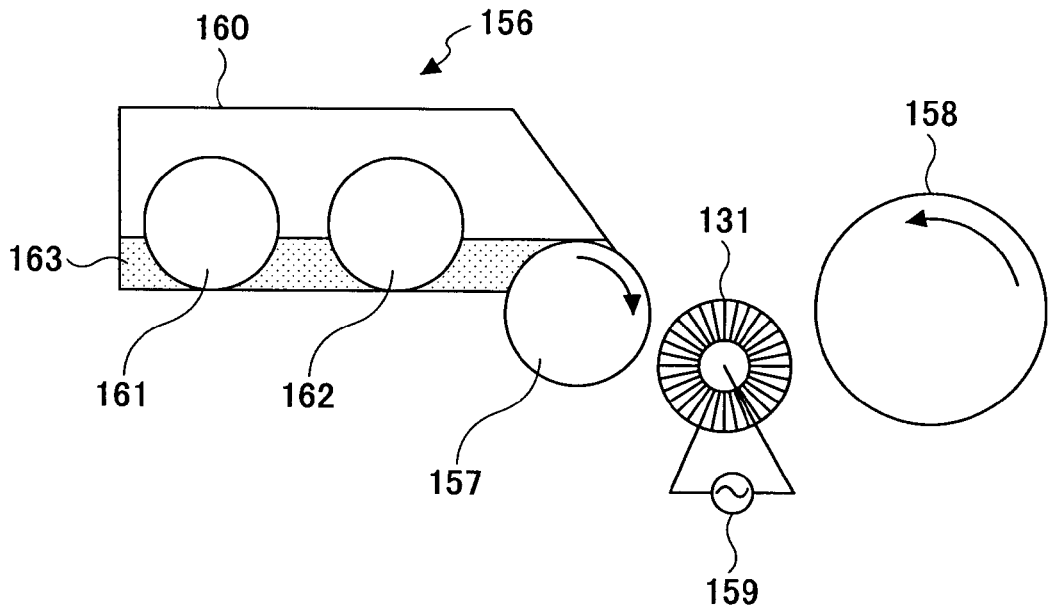
FIG. 33 is a cross-sectional view showing a development device according to a third embodiment of the present invention.

FIG. 33 is a schematic diagram showing an image forming apparatus according to the present embodiment. This image forming apparatus includes a development device employing the above-mentioned toner carrying roller 131. A spike of two-component developer is in abutment with the toner carrying roller 131 from a normal two-component development unit 156. Specifically, two-component developer in which magnetic carrier powder with a particle diameter of 50 [μm] and polyester toner with a particle diameter of about 6 [μm] are mixed from 7 to 8 [wt %] is conveyed to the toner carrying roller 131 using a magnet sleeve 157 of the two-component development unit 156, the magnet sleeve 157 including permanent magnet therein. In the toner carrying roller 131, a portion of the toner is transferred to the toner carrying roller 131 through a direct-current bias potential applied between the magnet sleeve 157 and the toner carrying roller 131. While the toner transferred to the toner carrying roller 131 forms flare on the toner carrying roller 131, the toner is conveyed to a portion facing a latent image carrier 158 when the toner carrying roller 131 is rotated by a driving unit not shown in the drawings. When the toner is attached to an electrostatic latent image on the latent image carrier 158 through a difference between an average potential of the surface of the toner carrying roller 131 and the potential of the latent image carrier 158, the electrostatic latent image is developed and a toner image is formed. In addition, an alternating voltage is applied between the electrode shaft 140A and the electrode shaft 140B as a bias potential from an alternating-current power supply 159 via an electrode brush or the like, and a potential difference is formed with a time period between the odd number electrode group including the electrodes 141, 143 . . . and the even number electrode group including the electrodes 142 . . . .

Toner which does not contribute to the development is returned from the image area to the magnet sleeve 157 again. Since the flare is formed, the adhesion of the toner to the toner carrying roller 131 is very low, so that the toner on the toner carrying roller 131 returned from the image area is readily scraped off or smoothed by the spike of the two-component development following in accordance with the rotation of the magnet sleeve 157. By repeating this, a substantially constant amount of toner flare is always formed on the toner carrying roller 131. While the two-component development unit 156 stirs two-component developer 163 in a container 160, the two-component development unit 156 conveys and circulates the two-component developer 163. The magnet sleeve 157 conveys a portion of the two-component developer to the toner carrying roller 131 and returns unnecessary toner which does not contribute the development from the development area.

An organic photoconductor with a thickness of 13 [μm] is used for the latent image carrier 158. The following describes a case where a latent image is formed using a laser writing system with a resolution of 1200 dpi. The photoconductor 158 is rotated by a driving unit not shown in the drawings and uniformly charged by a charging unit. The photoconductor 158 is exposed by the laser writing system as an exposure unit and an electrostatic latent image is formed. In this case, potential of charge of the photoconductor 158 ranges from −300 to −500 [V] and the electrostatic latent image is formed such that potential of writing in a solid area ranges from 0 to −50 [V].

The electrostatic latent image is developed using the toner forming the flare on the toner carrying roller 131 and a toner image is formed. In this case, when toner with a charge amount of about −22 [μC/g] and a particle diameter of 6 [μm] is used and conditions are examined so as to realize one dot of 1200 dpi with good filling in the solid area without scumming, a gap between the toner carrying roller 131 and the photoconductor 158 is about 500 [μm] and an alternating-current bias having −400 [V] and 0 [V] at peaks and an average potential of −200 [V] at each moment is applied at a frequency of 5 [kHz] from the alternating-current power supply 159 to the odd number electrode group and the even number electrode group of the toner carrying roller 131 (phases of the alternating-current bias are opposite to each other in the odd number electrode group and the even number electrode group).

The toner image on the toner carrying roller 131 is transferred by a transfer unit to a recording medium such as recording paper or the like fed from a paper feed unit. The toner image is fixed on the recording medium by a fixing unit and the recording medium is externally ejected. When excessive toner is on the toner carrying roller 131, an electric field curtain is shielded from electric charge of the toner and it is impossible to form a flare. In view of this, a direct-current bias of about 200 [V] is applied between the magnet sleeve 157 and the toner carrying roller 131 from the power supply such that an amount of toner per unit area on the toner carrying roller 131 is 0.2 [mg/cm$^2$]. In addition, because of a toner diffusion effect from the flare, slight unevenness is allowed upon transferring the toner from the magnet sleeve 157 to the toner carrying roller 131. No element or unit is required in particular between the magnet sleeve 157 and the toner carrying roller 131 so as to superpose the alternating-current bias on the direct-current bias. Moreover, no element or unit is required in particular so as to have a strictly uniform spike of the two-component developer.

On the other hand, an amount of toner required for a solid image on the photoconductor 158 is 0.4 [mg/cm$^2$], so that a movement speed of the toner carrying roller 131 is required to be not less than twice the movement speed of the photoconductor 158 so as not to generate a shortage of toner in the development area. In this case, the movement speed of the toner carrying roller 131 is 2.5 times higher than that of the photoconductor 158. A movement direction of the toner carrying roller 131 and a movement direction of the photoconductor 158 may be the same as shown in FIG. 33 or reverse to each other. A movement direction of the magnet sleeve 157 and a movement direction of the toner carrying roller 131 are preferably reverse to each other so as to have an effect of scraping off the returned toner as shown in FIG. 33. In the above-mentioned system, it is possible to realize high-quality development superior in filling in the solid area and 1200 dpi dot reproducibility without scumming based on a linear velocity of 300 [mm/s] of the photoconductor 158.

In the image forming apparatus according to the present embodiment, matrix resin of the toner (main component of toner) is made of polyester or styrene acrylic resin and regular charge polarity is minus polarity (negative polarity). And what is called a reversal development is performed in which a uniformly charge area (ground area) and the latent image area of the photoconductor 158 are made to have the same polarity as the regular charge polarity of the toner (minus polarity in this example) and the toner is selectively attached to the latent image area where the potential is reduced in comparison with the ground area.

The cylindrical toner carrying roller 131 in FIG. 33 includes the glass base 121, the plural electrodes (121, 122 . . . ), and the protection layer 123 for covering these electrodes as a surface protection layer as shown in FIG. 23. The protection layer 123 is made of materials for accelerating frictional electrification of the toner to the regular charge polarity (minus polarity in this example) in accordance with sliding friction with the toner hopping on the surface of the toner carrying roller 131 as a toner carrier. In other words, the toner is positioned in a minus side on frictional electrification series relative to the protection layer 123. Examples of materials of the protection layer 123 capable of realizing such a relationship include silicon, organic materials such as nylon, melamine resin, acrylic resin, PVA, urethane, and the like. Quaternary ammonium salt, nigrosine series dyes may be included. Further, metallic materials such as Ti, Sn, Fe, Cu, Cr, Ni, Zn, Mg, Al, and the like may be included. And inorganic materials such as $TiO_2$, $SnO_2$, $Fe_2O_3$, $Fe_3O_4$, CuO, $Cr_2O_3$, NiO, ZnO, MgO, $Al_2O_3$, and the like may be included. In addition, materials prepared by mixing at least two of the above-mentioned materials may be included.

In the image forming apparatus provided with the protection layer 123, the protection layer 123 (surface protection layer) of the toner carrying roller 131 as a toner carrier accelerates frictional electrification of the toner to the regular charge polarity in accordance with sliding friction with the hopping toner. And frictional electrification of the toner to the opposite polarity of the regular charge polarity in accordance with the sliding friction with the protection layer 123 is prevented. In accordance with this, reduction of the amount of charge (regular charge polarity) of the toner accompanied with hopping is prevented, so that it is possible to prevent generation of failure of development resulting from failure of toner hopping.

The regular charge polarity of the toner may be plus polarity (positive polarity). In this case, the protection layer 123 may be made of materials for accelerating frictional electrification of the toner to the plus polarity in accordance with the sliding friction with the toner.

Further, electrification series of toner indicate electrification series of an entire toner in which external additives such as silica, titanium oxide, and the like are added to the matrix resin of the toner (particles). It is possible to examine order in the electrification series as described in the following. After the toner is subjected to sliding friction with the surface protection layer for a predetermined time on the surface protection layer, the toner is collected through suction. The amount of charge of the collected toner is measured using an electrometer. When this measurement result shows an increase of the amount of charge of the toner in the negative polarity, the toner is in the minus side on the electrification series relative to the surface protection layer. When the measurement result shows an increase of the amount of charge of the toner in the positive polarity, the toner is in the plus side on the electrification series relative to the surface protection layer.

Figure 34:
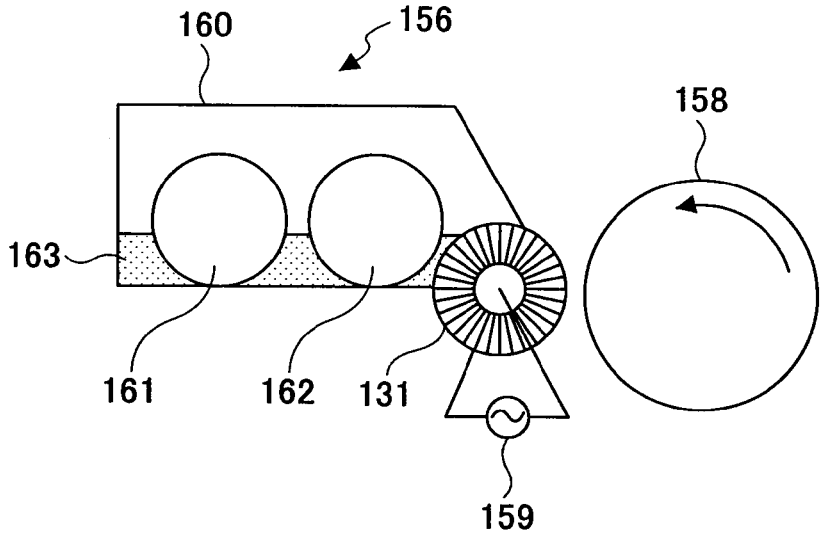
FIG. 34 is a cross-sectional view showing a development device according to a fourth embodiment of the present invention.

FIG. 34 shows another embodiment of the present invention. In this embodiment, in the embodiment of FIG. 33, the development unit 156 is simplified by omitting the magnet sleeve 157. Toner supply to the toner carrying roller 131 is performed through cascade development of two-component developer. The development unit 156 uses simple cascade and forms a thin toner layer on the toner carrying roller 131, so that a transfer rate of toner to the toner carrying roller 131 is reduced in comparison with the embodiment shown in FIG. 33. However, by increasing the rotation speed of the toner carrying roller 131, it is possible to support development speed of the photoconductor 158. A development device shown in FIG. 34 including the two-component development unit 156 and the toner carrying roller 131 in which the magnet sleeve 157 is omitted substantially has the same size as a conventional two-component development unit, so that the embodiment shown in FIG. 34 is capable of constituting a small and high-quality image creating engine.

Thus, according to the present embodiment, it is possible to realize higher image quality and configure a smaller development device in comparison with conventional techniques.

Figure 35:
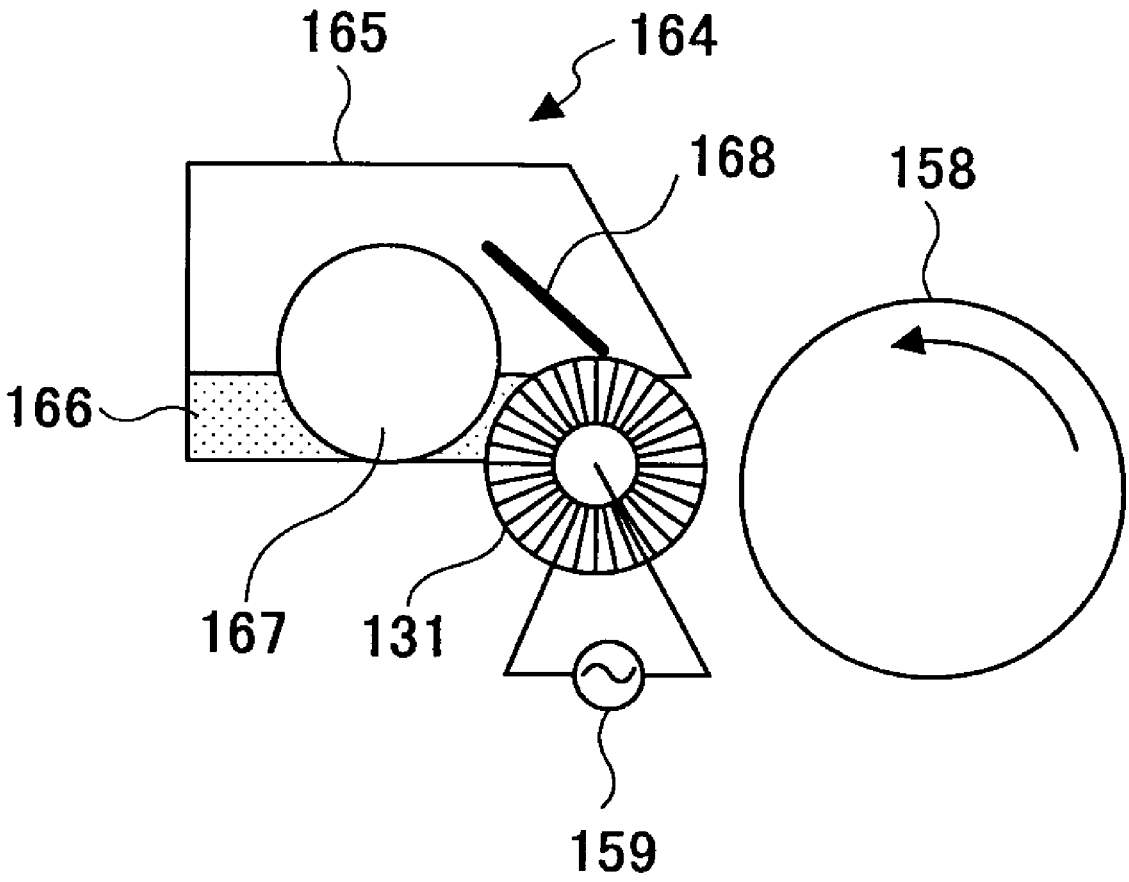
FIG. 35 is a cross-sectional view showing a development device according to a fifth embodiment of the present invention.

FIG. 35 shows another embodiment of the present invention. In this embodiment, in the embodiment shown in FIG. 34, a monocomponent development unit 164 having only toner is used instead of the two-component development unit 156. The monocomponent development unit 164 transfers the toner to the toner carrying roller 131 and forms a thin toner layer on the toner carrying roller 131. In this case, while the monocomponent development unit 164 stirs and circulates toner 166 in a container 165 using a circulation paddle 167, the monocomponent development unit 164 supplies the toner 166 to the toner carrying roller 131. The toner on the toner carrying roller 131 is regulated to have a certain thickness using a metering blade 168 as a toner regulation member so as to have a thin toner layer.

The embodiment shown in FIG. 35 is somewhat inferior to the embodiment shown in FIG. 33 and the embodiment shown in FIG. 34 in terms of stability of toner supply to the toner carrying roller 131. However, it is possible to solve this by adjusting conditions. According to the present embodiment, it is possible to provide a high-quality development device substantially reduced in size and weight.

Thus, according to the present embodiment, it is possible to realize higher image quality and a smaller development device in comparison with conventional techniques.

Figure 36:
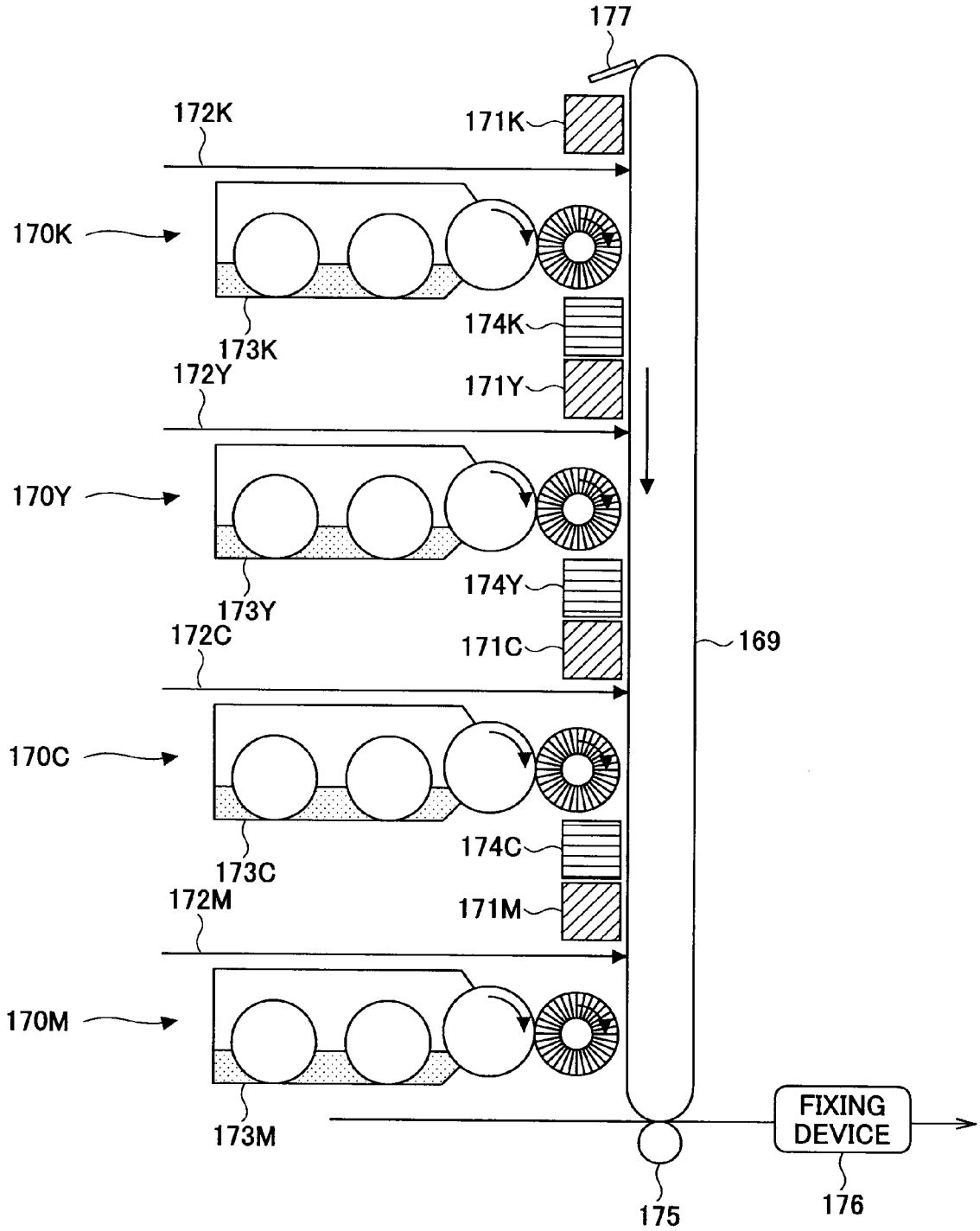
FIG. 36 is a cross-sectional view showing an image forming apparatus according to a sixth embodiment of the present invention.

FIG. 36 shows another embodiment of the present invention. This embodiment is constituted using the same development device as in the embodiment shown in FIG. 33 including the two-component development unit 156 and the toner carrying roller 131. This embodiment is an example of an image forming apparatus in which toner images of each color are superposed on a photoconductor. In this embodiment, an organic photoconductor 169 as a belt-shape photoconductor is installed between two rollers not shown in the drawings and rotated by a driving unit not shown in the drawings.

On a left side of the photoconductor 169, there are arranged image creating devices 170K, 170Y, 170C, and 170M as plural image forming units forming images of plural colors, namely, black, yellow, cyan, and magenta, for example. The photoconductor 169 is uniformly charged by a charging unit 171K at the image creating device 170K and the photoconductor 169 is exposed by a writing device as an exposure unit not shown in the drawings using a light beam 172K modulated in accordance with black image data, so that an electrostatic latent image is formed. The electrostatic latent image is developed by a development device 173K having the same structure as the development device in the above-mentioned embodiment including the two-component development unit 156 and the toner carrying roller 131 as shown in FIG. 33. As a result, a black toner image is formed. Thereafter, electricity of the photoconductor 169 is eliminated by a static charge eliminator 174K and the photoconductor 169 is prepared for the next image forming.

Next, the photoconductor 169 is uniformly charged by a charging unit 171Y at the image creating device 170Y and the photoconductor 169 is exposed by the writing device as an exposure unit not shown in the drawings using a light beam 172Y modulated in accordance with yellow image data, so that an electrostatic latent image is formed. The electrostatic latent image is developed by a development device 173Y having the same structure as the development device in the above-mentioned embodiment including the two-component development unit 156 and the toner carrying roller 131 as shown in FIG. 33. As a result, a yellow toner image is formed so as to be superposed on the black toner image. Thereafter, the electricity of the photoconductor 169 is eliminated by a static charge eliminator 174Y and the photoconductor 169 is prepared for the next image forming.

Next, the photoconductor 169 is uniformly charged by a charging unit 171C at the image creating device 170C and the photoconductor 169 is exposed by the writing device as an exposure unit not shown in the drawings using a light beam 172C modulated in accordance with cyan image data, so that an electrostatic latent image is formed. The electrostatic latent image is developed by a development device 173C having the same structure as the development device in the above-mentioned embodiment including the two-component development unit 156 and the toner carrying roller 131 as shown in FIG. 33. As a result, a cyan toner image is formed so as to be superposed on the black toner image and the yellow toner image. Thereafter, the electricity of the photoconductor 169 is eliminated by a static charge eliminator 174C and the photoconductor 169 is prepared for the next image forming.

Next, the photoconductor 169 is uniformly charged by a charging unit 171M at the image creating device 170M and the photoconductor 169 is exposed by the writing device as an exposure unit not shown in the drawings using a light beam 172M modulated in accordance with magenta image data, so that an electrostatic latent image is formed. The electrostatic latent image is developed by a development device 173M having the same structure as the development device in the above-mentioned embodiment including the two-component development unit 156 and the toner carrying roller 131 as shown in FIG. 33. As a result, a magenta toner image is formed so as to be superposed on the black toner image, the yellow toner image, and the cyan toner image. In this manner, a full-color image is formed.

On the other hand, a recording medium such as recording paper or the like is fed from a paper feed device not shown in the drawings. The full-color image on the photoconductor 169 is transferred to the recording medium by a transfer roller 175 as a transfer unit to which a transfer bias is applied from the power supply. In the recording medium to which the full-color image is transferred, the full-color image is fixed by a fixing device 176 and the recording medium is ejected outside. In the photoconductor 169, residual toner and the like is removed by a cleaner 177 as a cleaning unit after the full-color image is transferred.

The development devices 173K, 173Y, 173C, and 173M may employ the development device of FIG. 34 including the two-component development unit 156 and the toner carrying roller 131 or the development device of FIG. 35 including the monocomponent development unit 164 and the toner carrying roller 131.

In this embodiment, four color toner images are written on the same photoconductor 169, so that the color images are superposed on the photoconductor with little generation of positional displacement in principle and it is possible to obtain a high-quality full-color image without positional displacement in comparison with a conventional 4 drum tandem method.

In the image forming apparatus shown in FIG. 36, conditions of p[μm]<d[μm] are considered in view of the above-mentioned experimental results in addition to the conditions of Vmax[V]/p[μm]>1. In this structure, as mentioned above, the toner images formed on the photoconductor 169 are not affected. Further, a toner layer of previous color formed on the photoconductor 169 is not transferred in a development device of the following color. Thus, problems of scavenging or mixed color are eliminated and it is possible to stably perform a high-quality image creating process on a long-term basis.

Figure 37A:
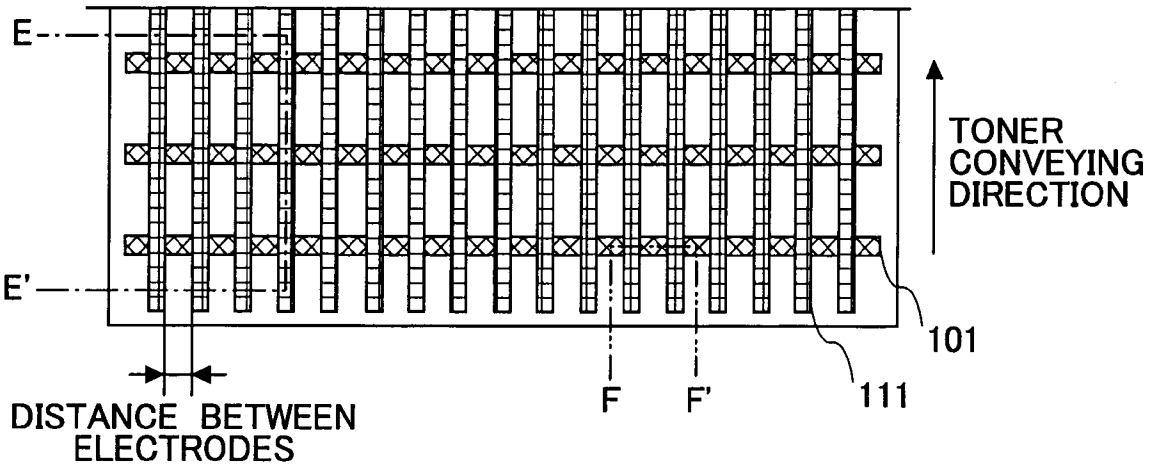
FIG. 37A is a diagram showing a structure of a development device according to the second embodiment of the present invention.
Figure 37B:
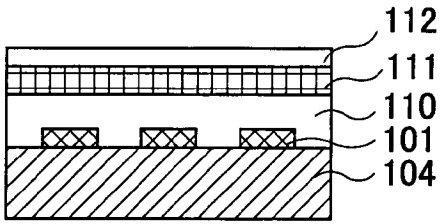
FIG. 37B is a cross-sectional view taken along line E-E' in FIG. 37A.
Figure 37C:
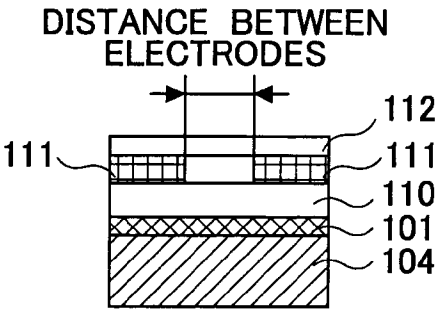
FIG. 37C is a cross-sectional view taken along line F-F' in FIG. 37A.

FIG. 37A is a diagram showing a structure of a development device according to a third embodiment of the present invention. As shown in FIG. 37A, plural perpendicular direction conveying electrodes 111 are arranged in an orthogonal direction relative to the conveying electrodes 101 of the conveying member 12 and at regular intervals in a width direction of the perpendicular direction conveying electrodes 111. Further, as shown in FIG. 37B which is a cross-sectional view taken along line E-E' in FIG. 37A and in FIG. 37C which is a cross-sectional view taken along line F-F' in FIG. 37A, on an insulating layer 110 laminated so as to cover the conveying electrodes 101 arranged on the support base 104, the perpendicular direction conveying electrodes 111 are arranged in the orthogonal direction relative to the conveying electrodes 101 and at regular intervals in the width direction and a surface protection layer 112 is laminated on the perpendicular direction conveying electrodes 111. In this manner, the perpendicular direction conveying electrodes 111 shown in FIG. 37A are configured to form an electric field in a perpendicular direction relative to an area formed with the toner conveying direction and a hopping direction of the toner. Thus, it is possible to improve uniformity of the toner in the width direction of the perpendicular direction conveying electrodes 111 by oscillating the toner in the orthogonal direction relative to the toner conveying direction. Basically, the toner is conveyed in the orthogonal direction relative to a longitudinal direction of the conveying electrodes 101. Linearity thereof is maintained even when a conveying distance is set to be long (15 cm, for example). Accordingly, when unevenness is generated in the width direction upon toner supply, the unevenness is maintained and has negative effects on image quality. In view of this, as shown in FIGS. 37A and 37C, plural perpendicular direction conveying electrodes 111 are disposed in parallel with the toner conveying direction in the entire width of the conveying electrodes 101 with an upper limit of several 100 μm for a distance between the electrodes. By applying positive and negative voltages as Vpp to each electrode at a specified frequency, the toner is moved in the toner conveying direction while being oscillated in the width direction. By realizing this, the unevenness in the width direction previously generated is reduced, so that the toner becomes uniform and it is possible to form a toner cloud layer having a uniform density.

Figure 38:
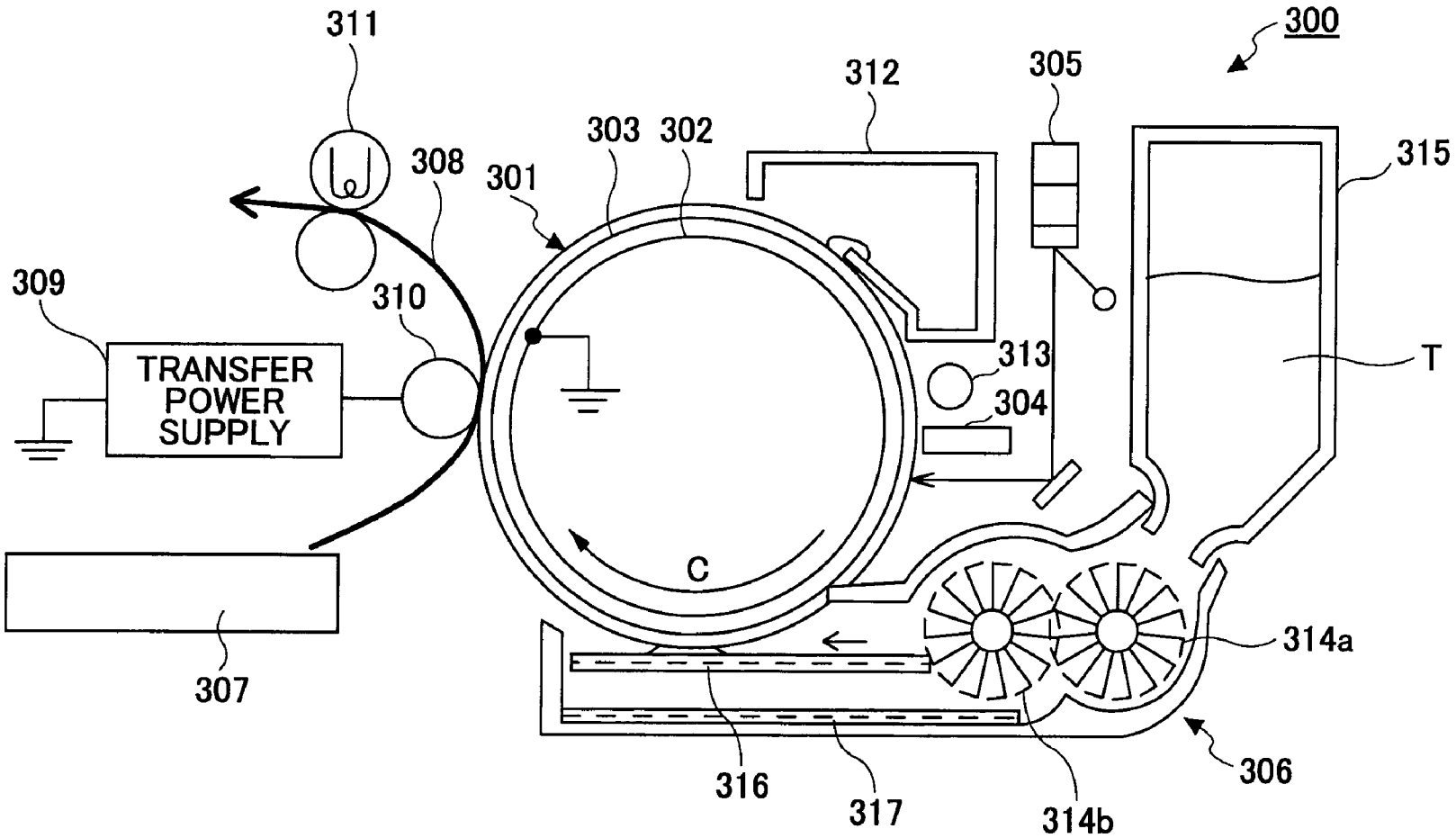
FIG. 38 is a schematic cross-sectional view showing an image forming apparatus according to a first embodiment of other aspect of the present invention on which the development device according to the present invention is installed.

The following describes an image forming apparatus according to a first embodiment of other aspect of the present invention with reference to FIG. 38 on which the development device according to the present invention is installed.

A schematic structure of an entire portion of the image forming apparatus and operations are described in the following. A photoconductor drum 301 as a latent image carrier includes a base 302 and a photoconductor layer 303 on the base 302. The photoconductor drum 301 is rotated in a direction indicated by an arrow C. The photoconductor drum 301 is uniformly charged by a charging unit 304 and an electrostatic latent image is formed on a surface of the photoconductor drum 301 through writing using a laser beam modulated in accordance with a read image from an exposure unit 305.

Then, the electrostatic latent image on the surface of the photoconductor drum 301 is visualized when toner is attached by a development device 306 according to the present invention. The visualized image is transferred to transfer paper (recording medium) 308 fed from a paper feed cassette 307 by a transfer runner 310 to which a voltage from a transfer power supply 309 is applied. The transfer paper 308 to which the visualized image is transferred is separated form the surface of the photoconductor drum 301 and fed through a space between rollers of a fixing unit 311, so that the visualized image is fixed and the transfer paper 308 is ejected to a paper ejection tray disposed outside the image forming apparatus.

On the other hand, toner residual on the surface of the photoconductor drum 301 after the transfer is finished is removed by a cleaning unit 312 and charge residual on the surface of the photoconductor drum 301 is eliminated by a charge eliminating lamp 313.

The operations of the development device according to the present invention are described. In a development device 306, charging brushes 314*a* and 314*b* are disposed so as to be brought into contact with each other and rotated, for example, as a member for charging toner powder. Toner T fed from a toner tank 315 is charged by receiving friction from the charging brushes 314*a* and 314*b*. The charged toner T is fed to a conveying base 316 and the toner T is conveyed on the conveying base 316 and caused to be hopping. The toner T is conveyed to a development area facing the photoconductor drum 301 as a latent image carrier and a required development is performed. Thereafter, residual toner T not subjected to the development is dropped from an end of the conveying base 316 and fed back to the member for charging toner (charging brush 314*b*) by a conveying base 317 for backward feed.

Structures of the conveying base 316 and the conveying base 317 for backward feed are the same as in the above-mentioned conveying base 102. A structure of a driving circuit for applying driving waveforms to each of electrodes on the conveying base 316 and the conveying base 317 for backward feed is the same as in the development device in each embodiment and emitted in the drawings.

By constructing the development device in this manner, it is possible to perform high-quality development and form a high-quality image. Further, by employing the uniform hopping height adjusting member in the present invention, it is possible to adjust a uniform hopping height for a toner cloud layer.

Figure 39:
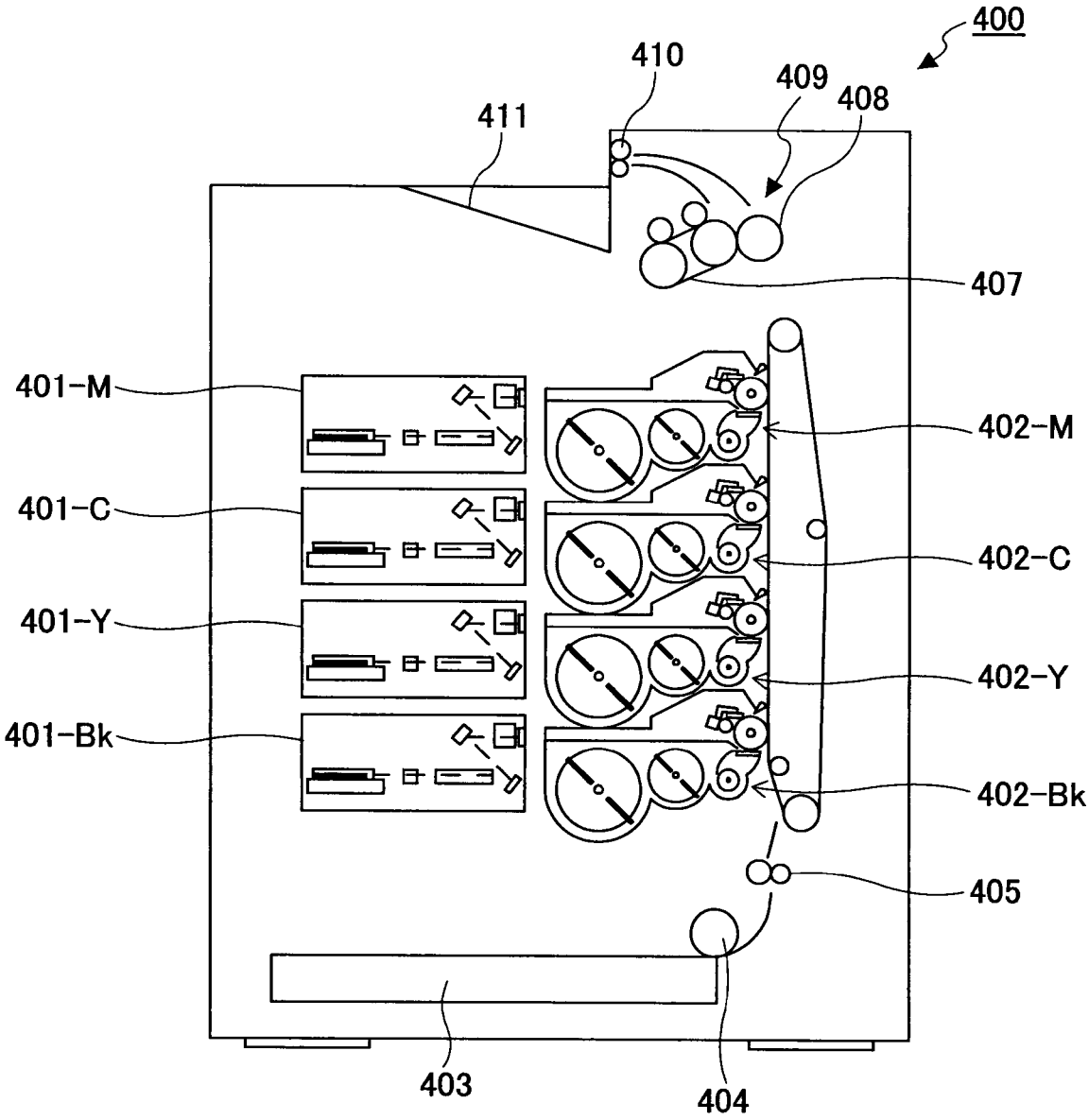
FIG. 39 is a schematic cross-sectional view showing an image forming apparatus according to a second embodiment of other aspect of the present invention on which the development device according to the present invention is installed.
Figure 40:
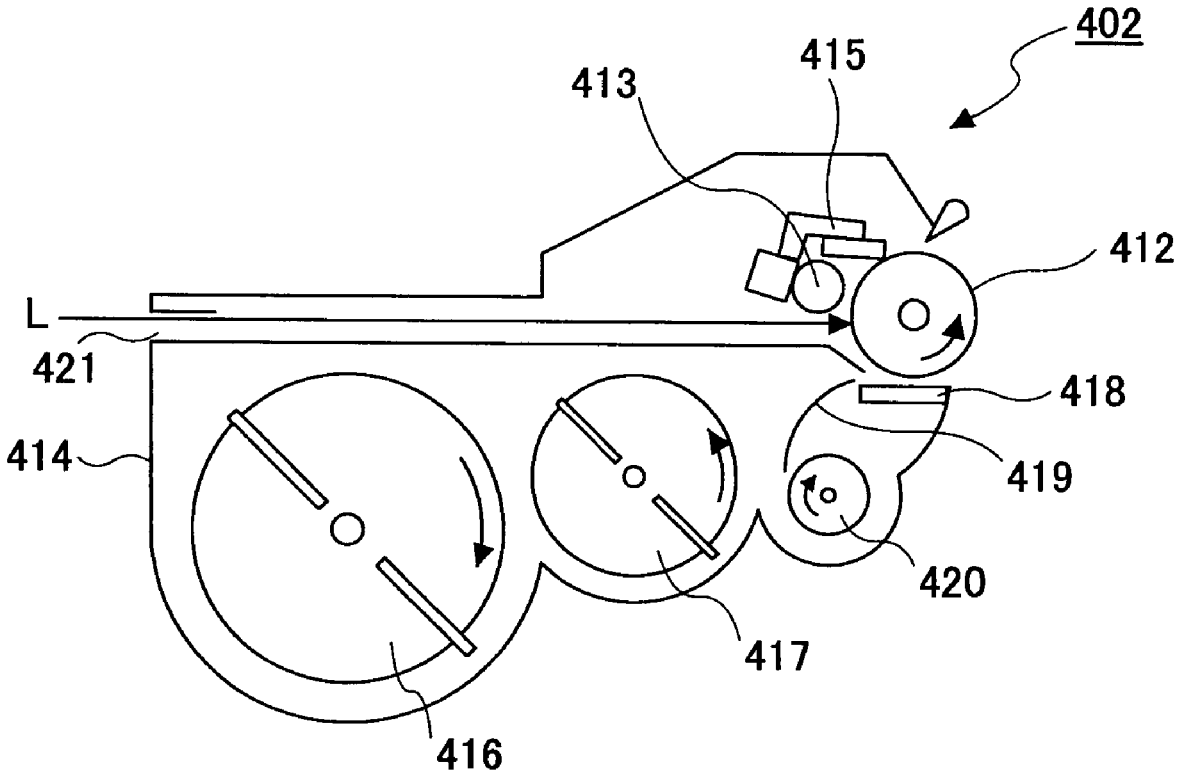
FIG. 40 is a schematic diagram showing a process cartridge of FIG. 39.

The following describes an image forming apparatus according to a second embodiment of other aspect of the present invention with reference to FIGS. 39 and 40 on which a process cartridge according to the present invention is installed. FIG. 39 is a schematic cross-sectional view showing an image forming apparatus provided with a process cartridge. And FIG. 40 is a schematic diagram showing the process cartridge.

An image forming apparatus 400 shown in FIG. 39 is an example of a laser printer for forming full-color images using four colors of magenta (M), cyan (C), yellow (Y), and black (Bk). The image forming apparatus 400 includes four optical writing devices 401-M, 401-C, 401-Y, and 401-Bk (hereafter collectively referred to as an optical writing device 401) for projecting a laser beam modulated in accordance with image signals of each color, four process cartridges 402-M, 402-C, 402-Y, and 402-Bk (hereafter collectively referred to as a process cartridge 402) for image creating, a paper feed cassette 403 for storing recording paper to which an image is to be transferred, a paper feed roller 404 for feeding the recording paper from the paper feed cassette 403, register rollers 405 for conveying the recording paper at a predetermined time, a transfer belt 406 for conveying the recording paper to a transfer unit of each process cartridge, a fixing device 409 configured using a fixing belt 407 and a pressure roller 408, the fixing device 409 fixing the image transferred to the recording paper, a paper ejection roller 410 for ejecting the recording paper to which the image is fixed to a paper ejection tray 411, and the like.

The process cartridge 402 configured using four process cartridges includes, as shown in FIG. 40, a drum-like photoconductor 412, a charging roller 413, a development device 414 according to the present invention, a cleaning blade 415, and the like in an integrated manner. The process cartridge 402 is configured to be detachable from a body of the image forming apparatus. By disposing the development device 414 inside the detachable process cartridge 402, it is possible to improve maintenance and to readily replace the development device 414 with other units at once.

Inside the development device 414, there are disposed a toner supply roller 416, a charging roller 417, a conveying base 418, a toner feed base 419 for feeding toner to the conveying base 418, and a toner return roller 420 for returning collected toner. In addition, toner of each color is stored in the development device 414. On a side of the process cartridge 402, a slit 421 is formed and used as a window onto which a laser beam from the optical writing device 401 is projected.

Each of the optical writing devices 401-M, 401-C, 401-Y, and 401-Bk includes a semiconductor laser, a collimate lens, an optical deflector such as a polygon mirror, an optical system for scanning and image forming, and the like. The optical writing device projects a laser beam modulated in accordance with image data for each color input from a host (image processing device) such as an external personal computer or the like. The projected laser beam performs scanning on the photoconductor 412 of each of the process cartridges 402-M, 402-C, 402-Y, and 402-Bk so as to write an electrostatic charge image (electrostatic latent image).

When image forming is started, the photoconductor 412 of each of the process cartridges 402-M, 402-C, 402-Y, and 402-Bk is uniformly charged by the charging roller 413 and the laser beam modulated in accordance with the image data is irradiated onto each photoconductor from each of the optical writing devices 401-M, 401-C, 401-Y, and 401-Bk, so that electrostatic latent images of each color are formed on the photoconductor.

The electrostatic latent image formed on the photoconductor 412 is developed and visualized through the ETH by the conveying base 418 of the development device 414 using toner of each color. Further, toner which is not subjected to the development is conveyed on the conveying base 418 and returned to an inlet of the toner feed base 419 by the toner return roller 420. In this manner, by performing development using the development device according to the present invention, it is possible to form a high-quality image as mentioned above.

On the other hand, the recording paper in the paper feed cassette 403 is fed by the paper feed roller 404 in synchronization with image forming of each color in each of the process cartridges 402-Bk, 402-Y, 402-C, and 402-M and conveyed to transfer belt 406 by the register rollers 405 at a predetermined time. The recording paper is carried on the transfer belt 406 and successively conveyed to the photoconductors 412 of the four process cartridges 402-Bk, 402-Y, 402-C, and 402-M. Toner images of each color of Bk, Y, C, and M are successively superposed and transferred. The recording paper to which the toner images of four colors are transferred is conveyed to the fixing device 409, where a color image made using the toner images of four colors is fixed and the recording paper is ejected to the paper ejection tray 411.

Figure 41:
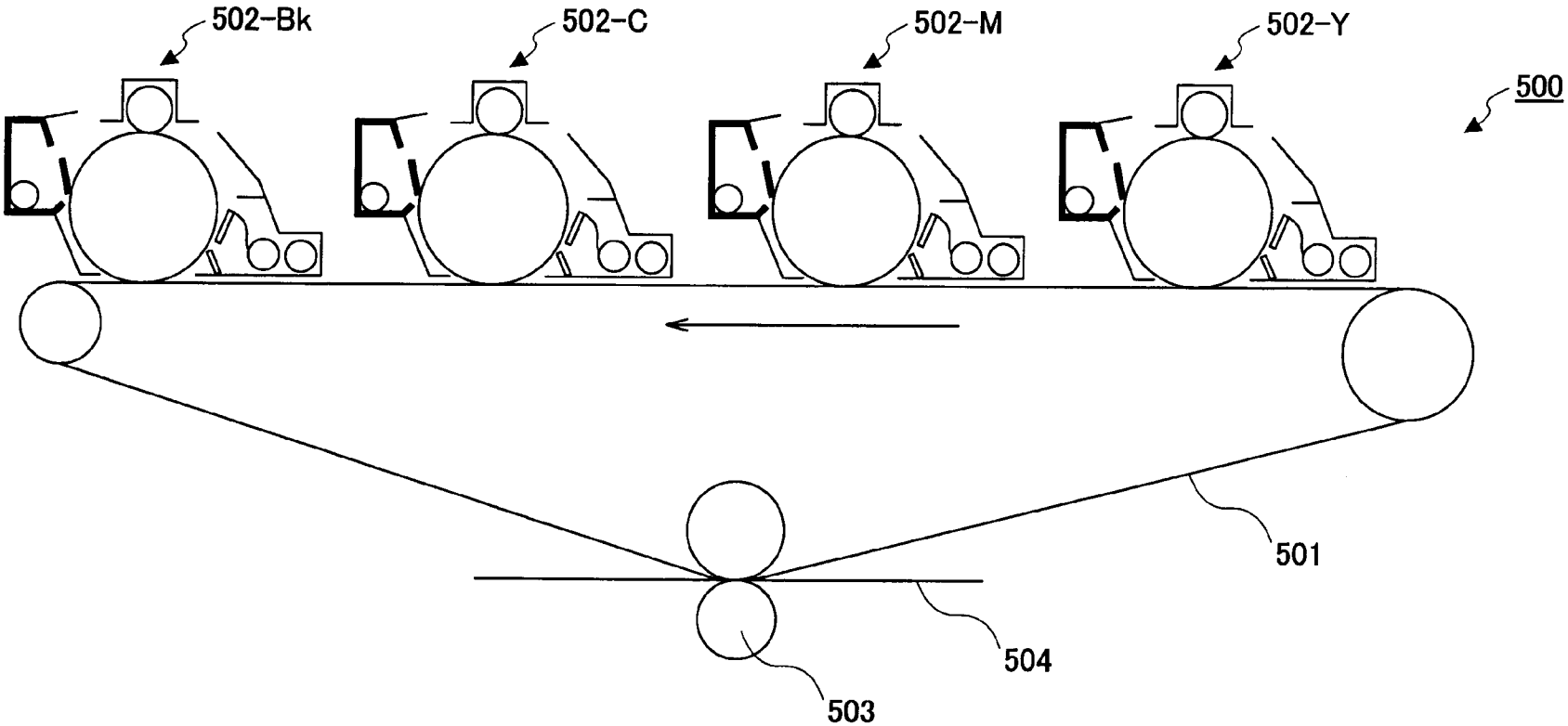
FIG. 41 is a schematic cross-sectional view showing an image forming apparatus according to a third embodiment of other aspect of the present invention on which the development device according to the present invention is installed.
Figure 42:
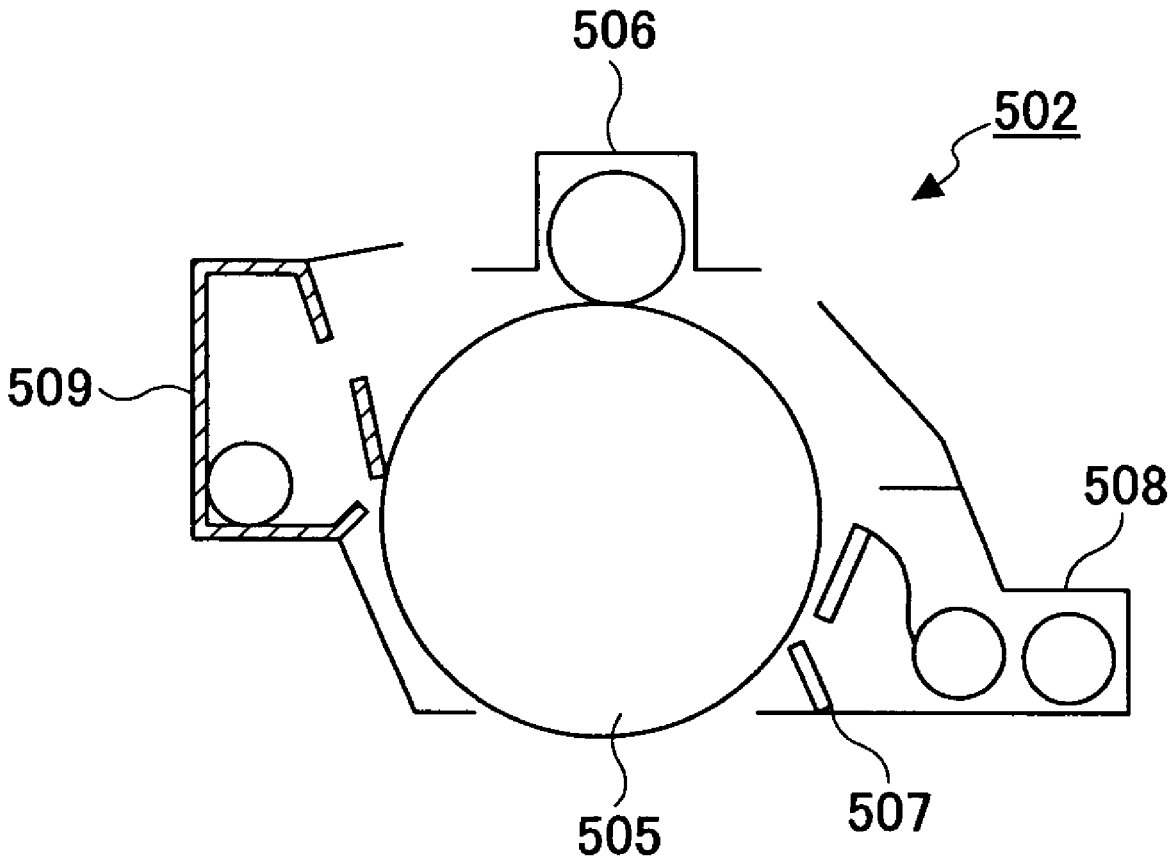
FIG. 42 is a schematic diagram showing a process cartridge of FIG. 41.

The following describes an image forming apparatus according to a third embodiment of other aspect of the present invention with reference to FIGS. 41 and 42 on which a process cartridge according to the present invention is installed. FIG. 41 is a schematic diagram showing an image forming apparatus provided with the process cartridge and FIG. 42 is a schematic diagram showing the process cartridge.

An image forming apparatus 500 shown in FIG. 41 is a color image forming apparatus using a tandem method in which process cartridges 502-Y, 502-M, 502-C, and 502-Bk of each color (hereafter collectively referred to as a process cartridge 502) are juxtaposed along with a transfer belt (image carrier) 501 extending in a lateral direction. Although the process cartridge 502 is described in order of yellow, magenta, cyan, and black, the order is not limited to this and the process cartridges may be juxtaposed in any order.

The process cartridge 502 shown in FIG. 42 includes plural elements of an image carrier 505, a charging unit 506, a development device 508 according to the present invention including a conveying base 507, a cleaning device 509, and the like as a process cartridge in an integrally connected manner. The process cartridge 502 is configured to be detachable from a body of an image forming apparatus such as a copying machine, a printer, and the like.

Usually, a color image forming apparatus is likely to have a large apparatus since plural image forming units are included. Further, when each of units such as the development device, the cleaning device, the charging unit, or the like separately has trouble or when the unit is to be replaced because of an end of life, it takes time and effort to replace the unit because of complexity of the apparatus.

In view of this, by constructing at least constituent elements of the image carrier and the development device in an integrally connected manner, it is possible to provide a small and highly durable color image forming apparatus capable of replacement by users.

In this case, toner on the image carrier 505 developed in the process cartridges 502-Y, 502-M, 502-C, and 502-Bk of each color is successively transferred to the transfer belt 501 extending in the lateral direction, to which a transfer voltage is applied.

In this manner, images of yellow, magenta, cyan, and black are formed on the transfer belt 501 in a multiple manner. The images are collectively transferred to a transfer material 504 by a transfer unit 503. The multiple toner images on the transfer material 504 are fixed by a fixing device not shown in the drawings.

The image forming apparatuses according to each of the above-mentioned embodiments are provided with the development device according to the present invention, so that it is possible to achieve a smaller apparatus and a lower cost and to improve image quality without toner scattering.

In the above-mentioned embodiments, toner is used as powder, for example. However, it is possible to apply the present invention to a device for conveying powder other than toner in the same manner, for example. Further, driving signals applied to the conveying electrodes are described based on the three phases, for example. However, the driving signals may have n phases (n is positive integer not less than 2), such as four phases, six phases, or the like.

The present invention is not limited to the specifically disclosed embodiment, and variations and modifications may be made without departing from the scope of the present invention.

The present application is based on Japanese priority application No. 2006-112835 filed Apr. 17, 2006, Japanese priority application No. 2007-018767 filed Jan. 30, 2007, the entire contents of which are hereby incorporated herein by reference.

What is claimed is:

1. A development device comprising:

a latent image carrier;

a conveying member disposed to face the latent image carrier, the conveying member having plural electrodes arranged at predetermined intervals to generate an electric field for moving toner on the conveying member, each electrode being insulated from neighboring electrodes;

a voltage application unit configured to apply a voltage of n phases to the electrodes to form a cloud of the toner and to adhere the toner to the latent image carrier forming a visualized toner image, n being a positive integer greater than one;

a toner supply unit configured to supply the toner to the conveying member;

a height adjusting member arranged at a predetermined distance from the conveying member and configured to adjust a uniform hopping height for a toner layer of the toner immediately before a development area on the conveying member;

an oscillation member configured to reduce collisions among toner particles in the toner layer by oscillating the height adjustment member; and a second voltage application unit configured to apply an alternating voltage to the height adjustment member.

2. The development device according to claim 1, wherein the voltage application unit forms a progressive-wave electric field for moving the toner on the conveying member to an area facing the latent image carrier.

3. The development device according to claim 1, wherein the toner is conveyed to an area facing the latent image carrier in accordance with movement of a surface of the conveying member in addition to the progressive-wave electric field formed by the voltage application unit.

4. The development device according to claim 3, wherein a potential difference is generated between an odd-numbered electrode group including odd-numbered electrodes and an even-numbered electrode group including even-numbered electrodes, the potential difference being determined based on a predetermined electrode of the plural electrodes, and pulse voltages, having shifted phases therebetween, are applied to the odd-numbered electrodes and the even-numbered electrodes to move the toner between the electrodes on the surface of the conveying member.

5. The development device according to claim 1, wherein the alternating voltage applied to the height adjusting member is a square wave having an amplitude in accordance with a charge of the toner.

6. The development device according to claim 1, wherein the height adjusting member is made of a material having flexibility.

7. The development device according to claim 1, wherein plural perpendicular direction conveying electrodes are disposed on the conveying member at predetermined intervals, the plural perpendicular direction conveying electrodes forming an electric field in a perpendicular direction relative to an area formed by a conveying direction and a hopping direction of the toner, and the toner is oscillated in a perpendicular direction relative to the conveying direction through the electric field formed by the perpendicular direction conveying electrodes to adjust a uniform width for the toner and a uniform hopping height of the toner layer.

8. The development device according to claim 1, wherein coverage of additive for the toner is not less than 40%.

9. The development device according to claim 1, further comprising:

a regulating member configured to maintain the uniform hopping height of the toner layer when the toner is transferred to the latent image carrier, the regulating member being arranged with a longest dimension parallel to a conveying direction.

10. The image forming apparatus according to claim 1, wherein the height adjusting member is held at a predetermined distance in a range of 0.12 mm to 0.24 mm.

11. A process cartridge comprising:

a development device including a latent image carrier, a conveying member disposed to face the latent image carrier, the conveying member having plural electrodes arranged at predetermined intervals to generate an electric field for moving toner on the conveying member, each electrode being insulated from neighboring electrodes, a voltage application unit configured to apply a voltage of n phases to the electrodes to form a cloud of the toner and to adhere the toner to the latent image carrier forming a visualized toner image, n being a positive integer greater than one, a toner supply unit configured to supply the toner to the conveying member, a height adjusting member arranged at a predetermine distance from the conveying member and configured to adjust a uniform hopping height for a toner layer of the toner immediately before a development area on the conveying member, an oscillation member configured to reduce collisions among toner particles in the toner layer by oscillating the height adjusting member, and a second voltage application unit configured to apply an AC voltage to the height adjustment member; and at least one of a latent image carrier, a charging unit, and a cleaning unit in an electrophotographic process, wherein the process cartridge is detachable from a body of an image forming apparatus.

12. The process cartridge according to claim 11, wherein the development device further comprises:

a regulating member configured to maintain the uniform hopping height of the toner layer when the toner is transferred to the latent image carrier, the regulating member being arranged with a longest dimension parallel to a conveying direction.

13. The image forming apparatus according to claim 11, wherein the height adjusting member is held at a predetermined distance in a range of 0.12 mm to 0.24 mm.

14. An image forming apparatus for forming an image by attaching powder to a latent image carrier and developing a latent image on the latent image carrier, the image forming apparatus comprising:

one of a development device and a process cartridge, including a latent image carrier, a conveying member disposed to face the latent image carrier, the conveying member having plural electrodes arranged at predetermined intervals to generate an electric field for moving toner on the conveying member, each electrode being insulated from the other electrodes, a voltage application unit configured to apply a voltage of n phases to the electrodes to form a cloud of the toner and to adhere the toner to the latent image carrier forming a visualized toner image, n being a positive integer greater than one, a toner supply unit configured to supply the toner to the conveying member, a height adjusting member arranged at a predetermined distance from the conveying member and configured to adjust a uniform hopping height for a toner layer of the toner immediately before a development area on the cylindrical conveying member, an oscillation member configured to reduce collisions among toner particles in the toner layer by oscillating the height adjusting member, and a second voltage application unit configured to apply an AC voltage to the height adjustment member; and at least one of a latent image carrier, a charging unit, and a cleaning unit in an electrophotographic process, wherein the process cartridge is detachable from a body of an image forming apparatus.

15. The image forming apparatus according to claim 14, wherein the development device further comprises:

a regulating member configured to maintain the uniform hopping height of the toner layer when the toner is transferred to the latent image carrier, the regulating member being arranged with a longest dimension parallel to a conveying direction.

16. The image forming apparatus according to claim 14, wherein the height adjusting member is held at a predetermined distance in a range of 0.12 mm to 0.24 mm.

* * * * *